US005764118A

United States Patent [19]

Saito et al.

[11] Patent Number: 5,764,118

[45] Date of Patent: Jun. 9, 1998

[54] DIELECTRIC COAXIAL FILTER WITH IRREGULAR POLYGON SHAPED RECESSES

[75] Inventors: Shoshichi Saito; Yasuji Nishino; Hisaya Tamura, all of Tochigi, Japan

[73] Assignee: Sony Chemicals Corporation, Tokyo, Japan

[21] Appl. No.: 770,507

[22] Filed: Dec. 20, 1996

Related U.S. Application Data

[63] Continuation of Ser. No. 277,582, Jul. 20, 1994, abandoned.

[30] Foreign Application Priority Data

Jul. 23, 1993 [JP] Japan ..... 5-182931
Dec. 28, 1993 [JP] Japan ..... 5-337235

[51] Int. Cl.[6] ..... H01P 1/202

[52] U.S. Cl. ..... 333/206; 333/222

[58] Field of Search ..... 333/202, 206, 333/207, 222, 223

[56] References Cited

U.S. PATENT DOCUMENTS

| | | | |
|---|---|---|---|
| 4,837,534 | 6/1989 | Van Horn | 333/207 |
| 4,890,079 | 12/1989 | Sasaki | 333/202 X |
| 4,937,542 | 6/1990 | Nakatuka | 333/202 |
| 5,177,458 | 1/1993 | Newell et al. | 333/206 |
| 5,208,565 | 5/1993 | Sogo et al. | 333/206 |
| 5,379,012 | 1/1995 | Shimizu et al. | 333/206 |
| 5,539,363 | 7/1996 | Maruyama et al. | 333/206 |

FOREIGN PATENT DOCUMENTS

| | | | |
|---|---|---|---|
| 0043904 | 2/1987 | Japan | 333/202 DB |
| 0109901 | 4/1989 | Japan | 333/202 DB |
| 3254202 | 11/1991 | Japan | 333/202 DB |
| 4160901 | 6/1992 | Japan | 333/206 |
| 4-356801 | 12/1992 | Japan | 333/202 DB |
| 5022002 | 1/1993 | Japan | 333/206 |

*Primary Examiner*—Robert Pascal
*Assistant Examiner*—Justin P. Bettendorf
*Attorney, Agent, or Firm*—Hill & Simpson

[57] ABSTRACT

A dielectric filter can be miniaturized. A dielectric filter comprised of a plurality of dielectric resonators ($R_1$), ($R_2$) having a dielectric block (11) with an outer conductor (12) and in which a plurality of through-holes (13), (13) bored through the dielectric block (11) and inner conductors (14) provided within the plurality of through-holes (13), (13) so as to be electrically connected on their one end faces to said outer conductor (12). Recesses (15) are formed on the other end faces of the plurality of through-holes (13) of the dielectric block (11), and electrodes (16) are formed within the recesses (15) so as to communicate with the inner conductors (14) to thereby construct an additional capacitance (Cp).

3 Claims, 23 Drawing Sheets

DIELECTRIC COAXIAL FILTER WITH IRREGULAR POLYGON SHAPED RECESSES

This is a (X) continuation, of application Ser. No. 08/277,582, filed Jul. 20, 1994 now abandoned.

BACKGROUND OF THE INVENTION

The present invention relates to a dielectric filter using a dielectric resonator.

As mobile telephones, personal radio mobile communication and broadcast using satellite are popularized recently, there is an increasing demand that "duplexer" used in a frequency range of about 500 to 2000 MHz, i.e., "antenna device for transmitter-receiver" should be miniaturized, made light in weight and inexpensive. Further, there is a demand that natural resources, such as rare earth metals, should be saved.

Most of this kind of duplexer is formed of a dielectric filter using a dielectric resonator.

FIG. 1 of the accompanying drawings shows an arrangement of this kind of dielectric filter using two dielectric resonators Ra, Rb. As shown in FIG. 1, the dielectric filter mainly comprises the two dielectric resonators Ra, Rb and three capacitors $C_1$, $C_2$, $C_3$. In that case, the characteristic of the dielectric filter is determined by the constants, of these elements Ra, Rb, $C_1$, $C_2$ and $C_3$.

In order to obtain a narrow band characteristic, two resonance frequencies fa, fb of the dielectric resonators Ra, Rb are selected to be substantially equal. When on the other hand a broader band characteristic is to be obtained, the resonance frequencies fa, fb are made different slightly.

Three capacitances of the capacitors $C_1$, $C_2$, $C_3$ are selected to be proper values in accordance with the resonance frequencies fa, fb.

A dielectric filter pass frequency band $f_{PB}$ appears in a frequency slightly lower than the resonance frequencies fa, fb. As the pass characteristic of the filter, there are obtained so-called single peak characteristic, flat characteristic and double humped response respectively shown by characteristic curves A, B, C in FIG. 2.

FIG. 3 shows a top view of a dielectric resonator R and FIG. 4 shows a cross-sectional view taken through the line IV—IV in FIG. 3. As illustrated, an outer conductor 2 is deposited on an outer peripheral surface of a cylindrical-shaped dielectric 1 along one end face of the dielectric 1. An inner conductor 4 is deposited into a central hole 3. One end of the inner conductor 4 is connected to an extended end of the outer conductor 2 formed on one end face of the dielectric 1, and the other end thereof is formed as an open end (driving end).

Operation of the fundamental dielectric resonator R will be described below.

Assuming now that a dielectric constant of a filling dielectric is $\epsilon$, an inner diameter of the filling dielectric is $D_1$ (mm), an outer diameter of the filling dielectric is $D_0$ (mm) and that a length of the filling dielectric is Le (mm), fundamental characteristics of the dielectric resonator R are as follows:

shortening coefficient of wavelength . . . $k=1/\sqrt{\epsilon}$ characteristic impedance . . . $W=(138\ k)\ \mathrm{Log}_{10}(D_0/D_1)$ ($\Omega$)

frequency . . . f (MHz)

velocity of light in vacuum . . . $c=3\times10^{11}$(mm/s)

wavelength obtained when the frequency is f . . . $\lambda=k\cdot c/(f\times10^6)$ (mm)

impedance at a driving end $T_{in3}$ . . . $Z_3=jW\cdot\tan(2\pi Le/\lambda)$ ($\Omega$)

where $j=\sqrt{-1}$.

Therefore, when $Le=\lambda/4$, a resonance state expressed as $Z_3=\pm j^{\infty}$ is obtained, and a frequency obtained at that time is a resonance frequency of the dielectric resonator.

Study of the above-mentioned relationship reveals that a material having a large dielectric constant $\epsilon$ (or small loss) should be used in order to miniaturize the dielectric resonator.

When the resonance frequencies fa, fb are selected to be 1000 MHz, the dielectric constant $\epsilon$ of a resultant material ranges from about 50 to 100 and therefore the following values are assumed.

Assuming that $\epsilon$ is 100, $D_1$ is 2 (mm), $D_0$ is 10 (mm), then W becomes 9.65 ($\Omega$), k becomes 0.1 and that $\lambda$ becomes 30 (mm). Accordingly, the dielectric resonator R is resonated under the condition that the length Le is 7.5 (mm). An impedance in the resonance frequency fa is maximized.

Let it be considered the case that an additional capacitor Cp is inserted to the driving end (open end) of the dielectric resonator R while the length Le is changed under the same conditions as described above.

Assuming that Le=5 (mm), then $Z_3=j9.65\tan(2\pi\cdot5/30)=j16.7$ ($\Omega$)

Assuming now that Cp=9.52 (pF), then an impedance Zc is expressed as:

$Zc=-j/(2\pi faCp)=-j16.7$ ($\Omega$)

Therefore, from $Z_4=1/((1/Z_3)+(1/Zc))$, we have:

Impedance $Z_4$ of a driving end Tin4=$\pm j\infty$

Thus, the impedance in the resonance frequency fa is maximized.

The two dielectric resonators shown in FIGS. 3, 4 and 5 obtain similar values of impedance characteristics in the vicinity of the resonance frequency fa. Accordingly, the length Le is reduced to 5 (mm) and substantially equivalent characteristics can be obtained.

FIG. 5 shows the case that the additional capacitor Cp is connected to the dielectric resonator R as the external element as described above. FIG. 6 is a cross-sectional view of an arrangement of other example of the dielectric. As shown in FIG. 6, a recess 5 is formed on the outer periphery of the central hole 3 on the end face of the dielectric 1 at its driving side of the dielectric resonator R. An additional electrode 6 is extended from the inner conductor 4 provided within the central hole 3 and deposited on the inner surface of the recess 5, thereby increasing a ground capacity of the driving end.

In this case, if the recess 5 is shallow, then this becomes equivalent to the case that a lumped constant capacitor, i.e., additional capacitance Cp is approximately interposed between the inner and outer conductors 4 and 2 of the resonator R. Thus, the length Le of the dielectric 1 is reduced.

While the dielectric 1 is formed as a proper cylinder in which the central hole 3, i.e., through-hole is bored on the central axis, the dielectric 1 is not limited to the cylinder shape and may be formed of a cylindrical dielectric whose cross section is regular square or rectangle. Also, even when the through-hole 3 is not limited to the central axis and may be deviated from the central axis, it is possible to construct the dielectric resonator. Furthermore, there can be constructed a dielectric resonator of a so-called top floating capacitor type in which the external capacitor is removed and the additional capacitance shown in FIG. 6 is provided.

When a dielectric filter using a plurality of dielectric resonators shown in FIG. 1 is constructed, as shown in FIG.

7 which is a top view thereof and in FIG. 8 which is a cross-sectional view taken through the line VIII—VIII in FIG. 7, a plurality of through-holes 13 are bored through a common, i.e., single dielectric block 11, inner conductors 14 are formed within these through-holes 13 along the through-holes 13 serving as the central holes, a common outer conductor 12 is deposited on the outer peripheral surface and one side end face of the dielectric block 11, and one end of the inner conductor 14 placed at the one side end face to which the outer conductor 12 of the dielectric block 11 is deposited is electrically connected to the outer conductor 12, whereby the dielectric resonators R, i.e., two resonators $R_1$, $R_2$ can be formed integrally with each of the through-holes 13.

FIG. 9 shows an arrangement that a filter corresponding to that shown in FIG. 1 is formed on the single dielectric block 11 by using a plurality of (two dielectric resonators in this example) of dielectric resonators $R_1$, $R_2$. FIG. 10 shows the arrangement of the dielectric filter shown in FIG. 9 more specifically. As shown in FIG. 10, the dielectric resonators $R_1$, $R_2$ and a chip assembly 23, such as an additional capacitor and input and output coupling capacitor are mounted within a shield case 21. There is provided a printed circuit board 22 with a predetermined interconnection formed thereon. A predetermined connection terminal 24 is led out from the shield case 21.

FIG. 11 is a cross-sectional view showing another example of a dielectric filter. In FIG. 11, like parts corresponding to those of FIG. 10 are marked with the same references. In this example, the dielectric resonators $R_1$, $R_2$ provided within the shield case 21 and the chip assembly 23 mounted on the printed circuit board 22 are connected together. Further, the connection terminal 24 is connected to the chip assembly 23.

The dielectric filter of integral type in which a plurality of dielectric resonators are integrally formed on the single dielectric block can be simplified in structure and made miniaturized and compact. Also, the assembly structure thereof can be simplified.

However, as shown in FIGS. 10 and 11, the dielectric filter in which a plurality of resonators are integrally formed on the single dielectric block includes the chip assembly 23, such as the additional capacitor and the input coupling capacitor and further includes the printed circuit board 22 on which the additional capacitor and the input coupling capacitor are interconnected and attached. Further, since this dielectric filter includes the connection terminal 24, the number of assembly thereof is increased and the dielectric filter itself is increased in size.

SUMMARY OF THE INVENTION

In view of the aforesaid aspect, it is an object of the present invention to provide a dielectric filter in which the number of assembly parts can be reduced.

It is another object of the present invention to provide a dielectric filter which can be miniaturized.

According to the present invention, there is provided a dielectric filter which is comprised of a plurality of dielectric resonators comprising a dielectric block having an outer conductor and a plurality of through-holes, the plurality of through-holes having inner conductors electrically connected to the outer conductor, recesses formed on the other end surfaces of the plurality of through-holes of the dielectric block, and electrodes formed within said recesses so as to communicate with the inner conductor to thereby form an additional capacitance.

According to the dielectric filter of the present invention, the dielectric block includes second recesses formed on its surface in which an additional capacitance for the dielectric resonators are formed and the second recesses include electrodes formed therein to construct at least one of input and output coupling capacitances.

According to the dielectric filter of the present invention, the electrodes formed in the recesses in which the additional capacitance for the dielectric resonators are formed are shaped such that lengths thereof are changed at their portions opposing ground electrodes parallel to the through-holes.

According to the dielectric filter of the present invention, shapes of electrodes formed in the recesses constructing the additional capacitance for the dielectric resonator are selected such that they have large coupling capacitances only for ground electrodes, terminal electrodes and electrodes of adjacent recesses so that a pass band center frequency, a pass band width and a selectivity in a filter transmission characteristic can be adjusted independently.

According to the dielectric filter of the present invention, a dielectric constant of a dielectric material used on the side in which the electrodes of recesses constructing the additional capacitance for the dielectric resonators is selected to be lower than a dielectric constant of a dielectric body.

According to the dielectric filter of the present invention, the dielectric block has slits extended to one side wall on its surface of a side in which the additional capacitance for the dielectric resonators is constructed and electrodes formed on the inside of the slits to thereby form input and output coupling capacitances.

According to the present invention, the dielectric filter further includes a substrate in which conductor patterns corresponding to a surface mount are formed being electrically connected thereto on its surface in which the additional capacitances for the dielectric resonators are constructed.

Further, according to the dielectric filter of the present invention, input and output coupling capacitances are formed by disposing a dielectric in which an input and output terminal electrode is formed on at least one surface in the plurality of recesses.

Furthermore, according to the present invention, the dielectric filter further includes coils connected between input and output terminal electrodes of the dielectrics disposed in the plurality of recesses.

According to the present invention, since the recesses are formed on the dielectric block in which a plurality of dielectric resonators are formed and the electrodes communicating with the central conductor are formed in the recesses, the ground electrode area of the side (driving terminal side) in which the inner conductor and the outer conductor are not electrically connected is increased, which becomes equivalent to the case that the additional capacitance is provided. Therefore, the capacitance value of the additional capacitance can properly be set by selecting the depth, the shape and the area of the recess, whereby the lengths of the resonators can be reduced.

According to the present invention, since the second recess is formed on the dielectric block at its side in which the additional capacitance is constructed, the electrode is constructed within the recess and the coupling capacitances are constructed between these electrodes, the external coupling capacitor need not be connected.

According to the present invention, since the recess in which the additional capacitance is constructed is shaped such that the portion thereof opposing the ground electrode is changed in length, it is possible to fine adjust the resonance frequencies of the dielectric resonators.

According to the present invention, since the shape of the recess in which the additional capacitance is formed is selected such that a large coupling capacitance is given to only the ground electrode, the terminal electrode or the electrode of the adjacent recess and a coupling capacitance for other electrodes is reduced, the pass band center frequency, the pass band width and the selectivity in the transmission characteristic of the filter can be adjusted independently. Therefore, the pass, band center frequency, the pass band width and the selectivity can be adjusted accurately without being affected each other when the dielectric filter is produced.

According to the present invention, since the dielectric constant of the dielectric material used in the recess in which the additional capacitance is constructed on its side in which the electrode is formed is selected to be lower than the dielectric constant of the dielectric body, it is possible to change the sizes of the electrode in the recess and the terminal electrode in response to the purpose.

According to the present invention, since the dielectric block has on its surface of the side in which the additional capacitance for the dielectric resonators is constructed the slit extended to one side surface and the electrode is formed on the inside of the slit to thereby form the input and output coupling capacitances, the dielectric filter can be surface-mounted on the mount substrate with ease by using this electrode.

According to the present invention, since the substrate in which the conductor patterns corresponding to the surface mount are formed is electrically connected to the surface in which the additional capacitance is constructed, the dielectric filter can be easily surface-mounted on the mount substrate by using the conductor patterns.

Further, according to the present invention, since the input and output coupling capacitances are constructed by disposing the dielectric in which the electrode is formed on at least one surface in a plurality of recesses of the dielectric block, the external coupling capacitor need not be connected and the dimension of the dielectric filter can be prevented from being increased considerably. In this case, since the electrode constructing the coupling capacitances is served also as the input and output terminal, the dielectric filter can be surface-mounted on the mount substrate without providing a new electrode.

Furthermore, according to the present invention, since the coils are connected between the input and output electrodes of the dielectric disposed in a plurality of recesses, it is possible to construct the band elimination filter without using the conventional repeating substrate.

DETAILED DESCRIPTION OF THE PREFERRED EMBODIMENTS

A dielectric film according to the present invention will now be described with reference to the drawings. In the embodiment of the present invention, the dielectric filter is formed of two dielectric resonators $R_1$, $R_2$.

Figure 1:
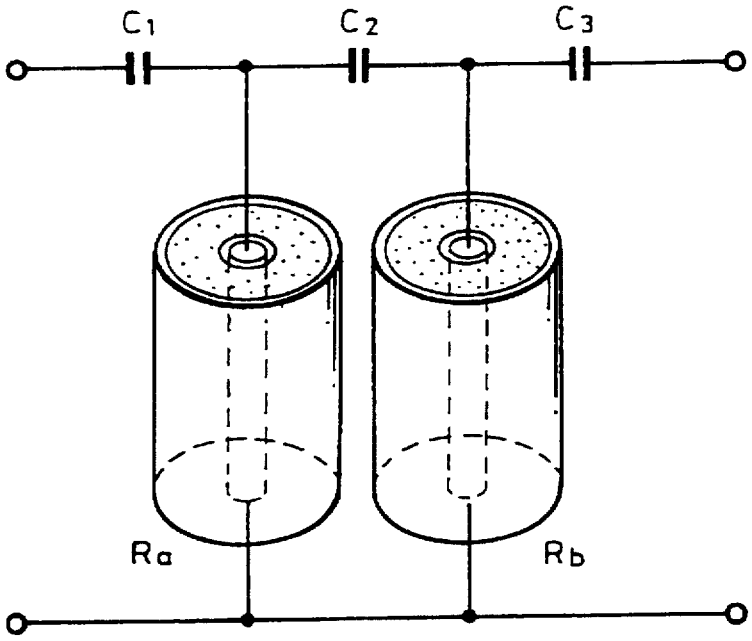
FIG. 1 (PRIOR ART)
FIG. 1 is a schematic diagram showing a dielectric filter using a dielectric resonator.
Figure 2:
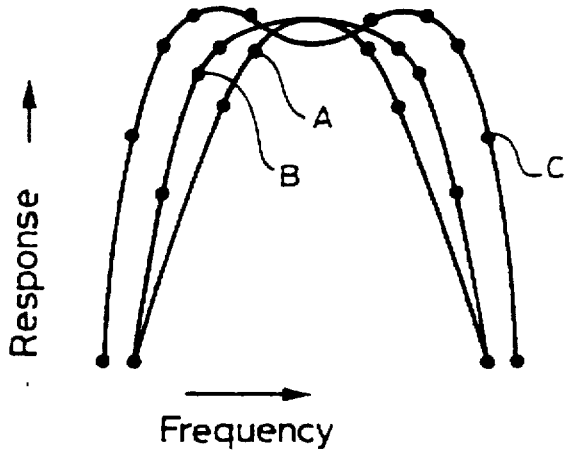
FIG. 2 (PRIOR ART)
FIG. 2 is a graph of characteristic curves obtained when a frequency versus response characteristic was measured.
Figure 3:
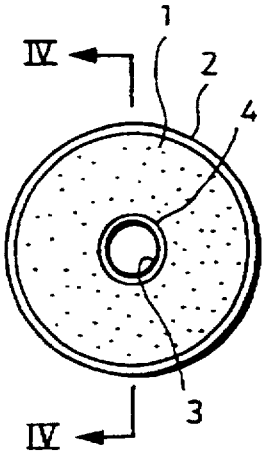
FIG. 3 (PRIOR ART)
FIG. 3 is a top view of a dielectric resonator.
Figure 4:
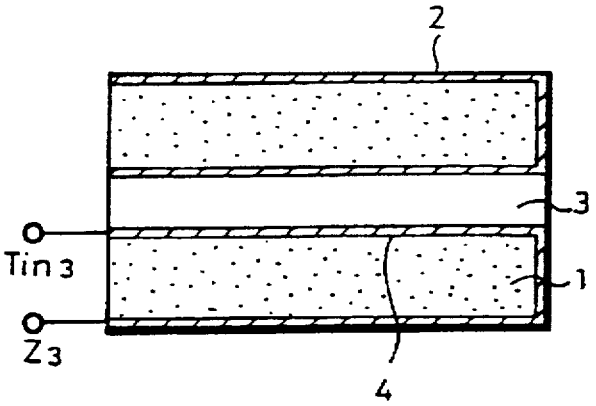
FIG. 4 (PRIOR ART)
FIG. 4 is a cross-sectional view taken through the line IV—IV in FIG. 3.
Figure 5:
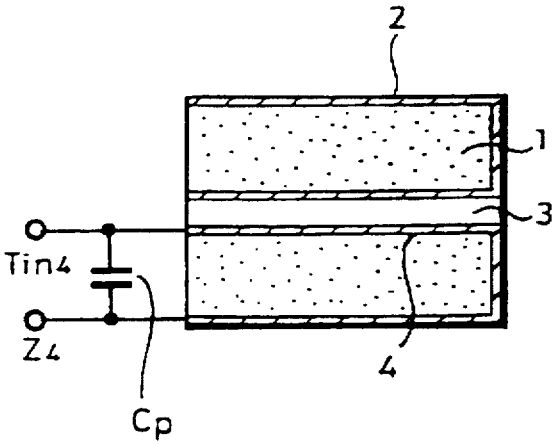
FIG. 5 (PRIOR ART)
FIG. 5 is a cross-sectional view of the dielectric resonator.
Figure 6:
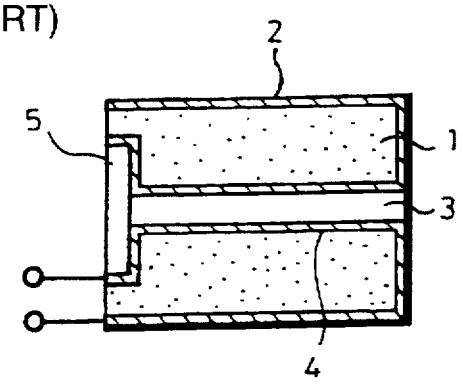
FIG. 6 (PRIOR ART)
FIG. 6 is a cross-sectional view of other example of the dielectric resonator.
Figure 7:
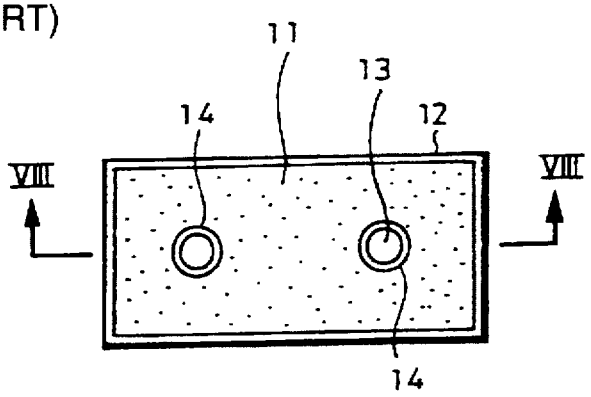
FIG. 7 (PRIOR ART)
FIG. 7 is a top view showing other example of the dielectric resonator.
Figure 8:
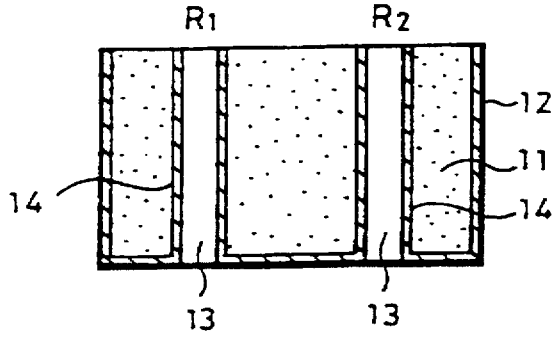
FIG. 8 (PRIOR ART)
FIG. 8 is a cross-sectional view taken through the line VIII—VIII in FIG. 7.
Figure 9:
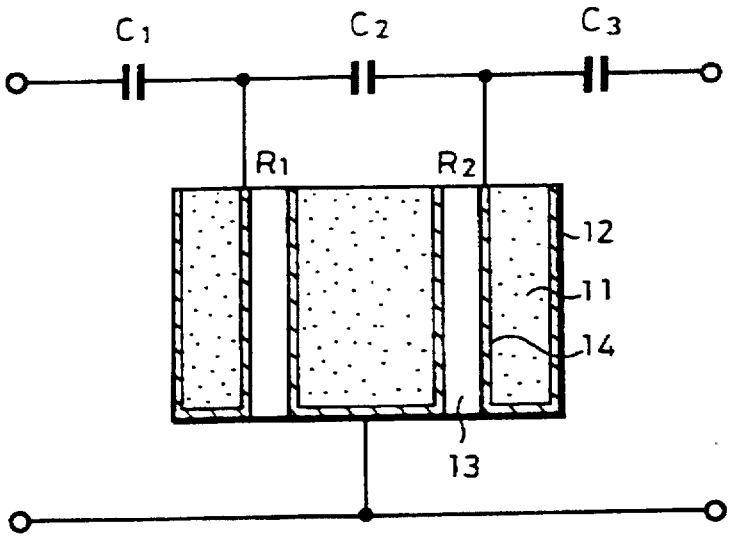
FIG. 9 (PRIOR ART)
FIG. 9 is./a diagram showing another example of the dielectric filter.
Figure 10:
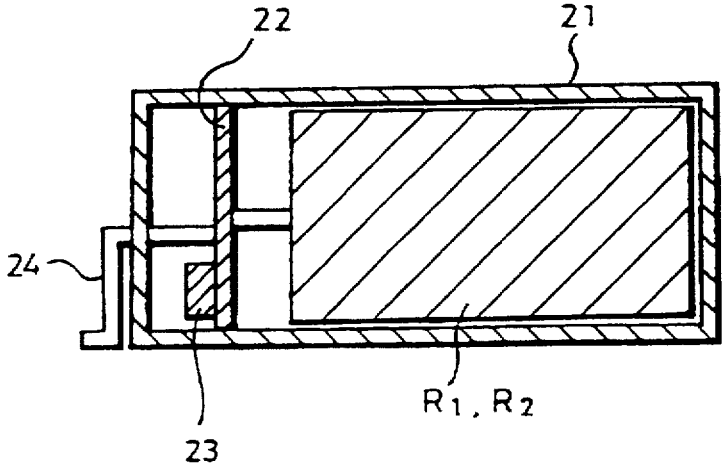
FIG. 10 (PRIOR ART)
FIG. 10 is a cross-sectional view showing the arrangement of the dielectric filter shown in FIG. 9 more specifically.
Figure 11:
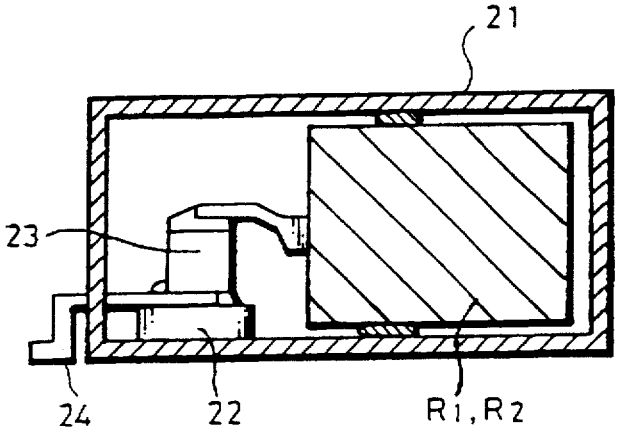
FIG. 11 (PRIOR ART)
FIG. 11 is a cross-sectional view showing an arrangement of another example of the dielectric filter.
Figure 12:
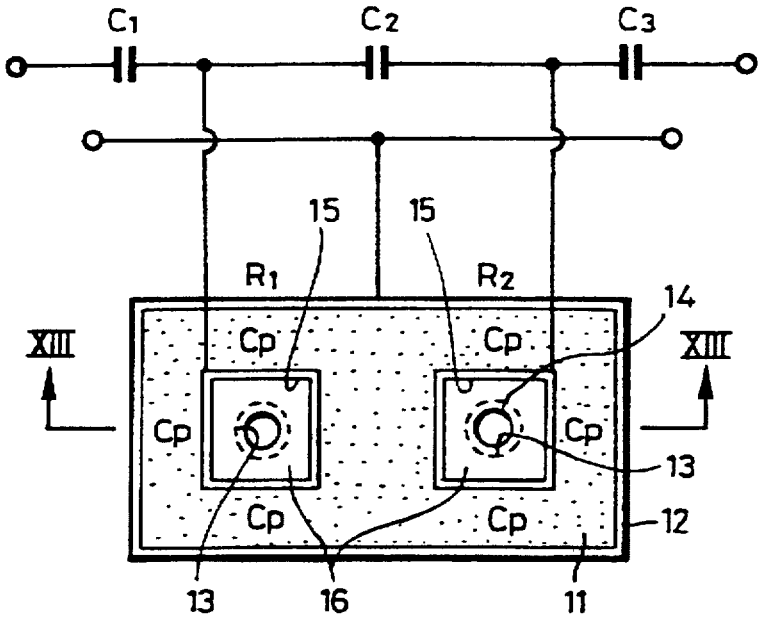
FIG. 12 is a top view showing a dielectric filter according to a first embodiment of the present invention.

According to this embodiment, there is prepared the dielectric block 11 of rectangular parallelpiped configuration, for example, as shown in FIG. 12. The dielectric block 11 is made of compound having a high dielectric constant, such as composite Perovskite of Ba, e.g., $Ba(Zn_{1/3}Ta_{2/3})O_3$, $Ba(Mg_{1/3}Ta_{2/3})O_3$ or the like or (PbBa)$)—Nd_2O_3—TiO_2$, $(BaSr)O—Sm_2O_3—TiO_2$, $BaO—(NdSm)_2O_3—TiO_2$ of $Ba\text{-}TiO_2$ in which a part of Ba is substituted with Pb and Sr.

The dielectric block 11 includes two parallel through-holes 13 at its center along the longitudinal direction with a predetermined spacing therebetween.

Recesses 15 are formed on one major surface 111 of the dielectric block 11 around the opening portions of the respective through-holes 13.

A conductive layer is deposited on the whole surface including the inner surfaces of the through-holes 13 and the recesses 15 of the dielectric block 11 by some suitable means, such as baking of silver paste, electroless copper plating and electroplating, if necessary. Thereafter, the dielectric block 11 is polished at its major surface 111 side having the recesses 15 so that only the conductive layer on the major surface 111 is removed.

In this way, there are constructed dielectric resonators $R_1$, $R_2$ in which the outer conductor 12 is formed around the outer peripheral surface of the dielectric block 11 and the major surface 112 opposite to the major surface 111, the inner conductors 14 are formed within the through-holes 13 and the electrodes 16 are formed in the recesses 15.

One end of the inner conductor 14 is connected to the outer conductor 12 and the other end is connected to the electrode 16 formed within the recess 15. The resonators $R_1$, $R_2$ are formed in the two through-holes 13 on one dielectric block 11. In the respective resonators $R_1$, $R_2$, the earth capacities are increased due to the existence of the recesses 15 and the electrodes 16 to form the additional capacitance Cp, thereby the resonator length being reduced.

Figure 13:
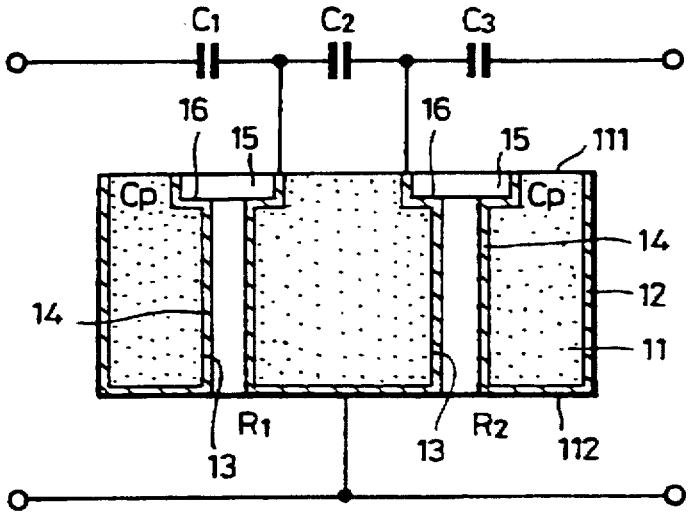
FIG. 13 is a cross-sectional view taken along the line XIII—XIII in FIG. 12.

The two resonators $R_1$, $R_2$ thus arranged construct a dielectric filter by connecting coupling capacitances $C_1$ to $C_3$ thereto from the outside as shown in FIG. 13.

Figure 14:
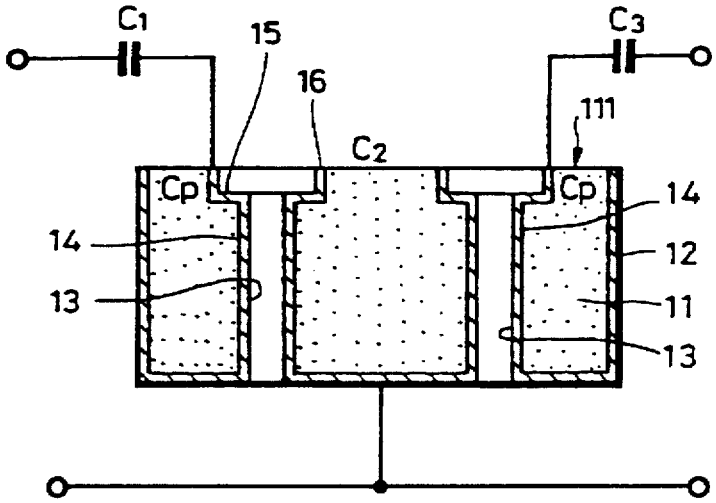
FIG. 14 is a diagram showing an arrangement of a dielectric filter according to the present invention.

In that case, the coupling capacitor $C_2$ is produced by producing a parasitic electrostatic capacitance between the two resonators $R_1$ and $R_2$ by selecting the spacing between the two resonators $R_1$ and $R_2$, the depths of the recesses 15 and the spacing between the recesses 15. Thus, it becomes possible to remove the external coupling capacitor $C_2$ as shown in FIG. 14.

Figure 15:
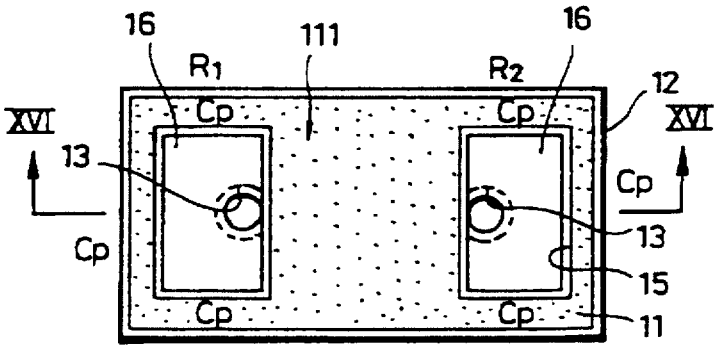
FIG. 15 is a top view showing a dielectric filter according to another embodiment of the present invention.
Figure 16:
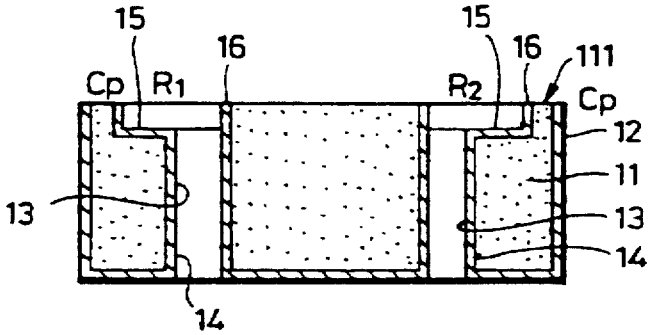
FIG. 16 is a cross-sectional view taken along the line XVI—XVI in FIGS. 15.

While the through-hole 13 and the recess 15 are disposed concentrically in the examples shown in FIGS. 12 and 13, the present invention is not limited thereto and the through-hole 13 and the recess 15 may be displaced from each other as shown in FIGS. 15 and 16. FIG. 15 is a top view of such dielectric filter and FIG. 16 is a cross-sectional view taken along the line XIV–XVI in FIG. 15.

The shape of the recess 15 is selected from a wide variety of shapes, such as square, rectangle, circle and H-letter or L-letter shape shown in FIGS. 17, 18 and FIGS. 25A to 25D, which will be described later on, in response to the necessary additional capacitance Cp and the capacitance of the coupling capacitor $C_2$ or the like.

Figure 20:
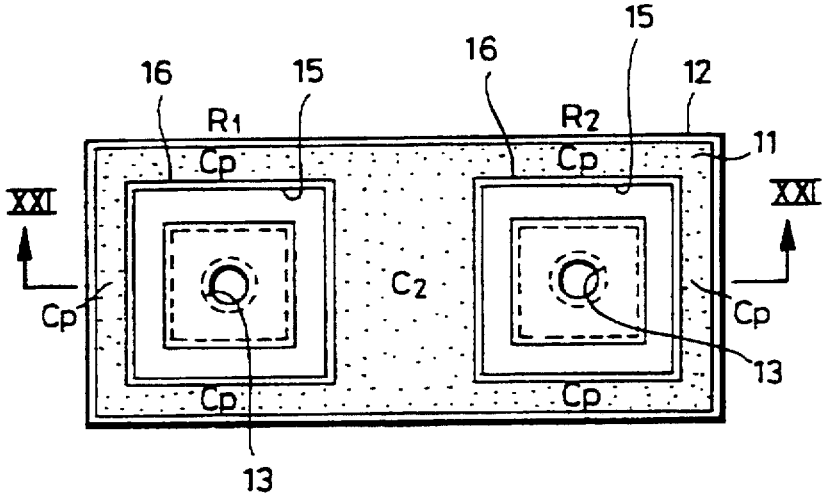
FIG. 20 is a top view showing a dielectric filter according to another embodiment of the present invention.
Figure 21:
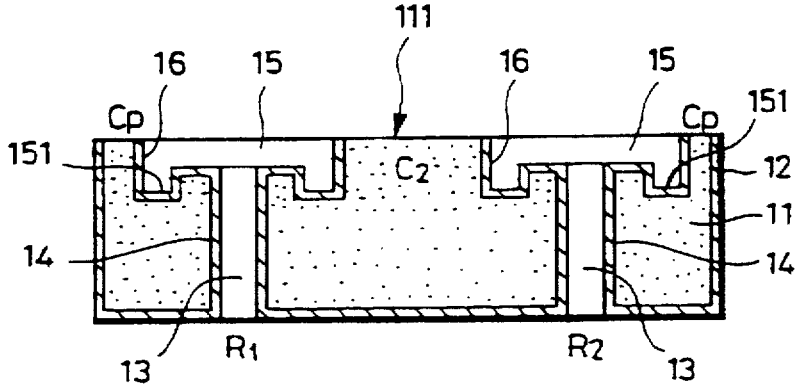
FIG. 21 is a cross-sectional view taken along the line XXI—XXI in FIG. 20.

When it is desired to increase the additional capacitance Cp, or the thickness (resonator length) Le of the dielectric filter 11 is reduced, as shown in FIG. 20 which is a top view of the dielectric filter according to another embodiment of the present invention and as shown in FIG. 21 which is a cross-sectional view taken along the line XXI—XXI in FIG. 20, one of a plurality of annular ancillary recesses 151 are formed on the bottom surfaces of the recesses 15 and the electrodes 16 are deposited on the inner surfaces of the annular ancillary recesses 115 at the same time when other conductors 12, 14 are formed, thereby making it possible to increase the areas of the electrodes 16.

Figure 17:
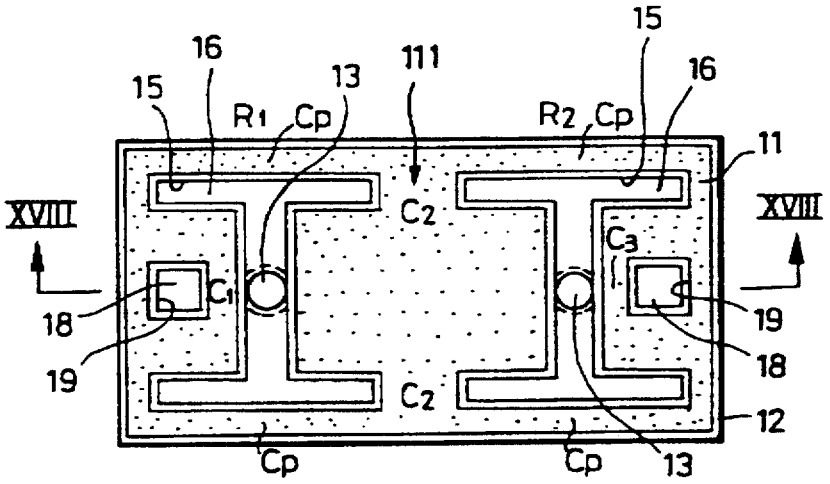
FIG. 17 is a top view showing a dielectric filter according to another embodiment of the present invention.
Figure 18:
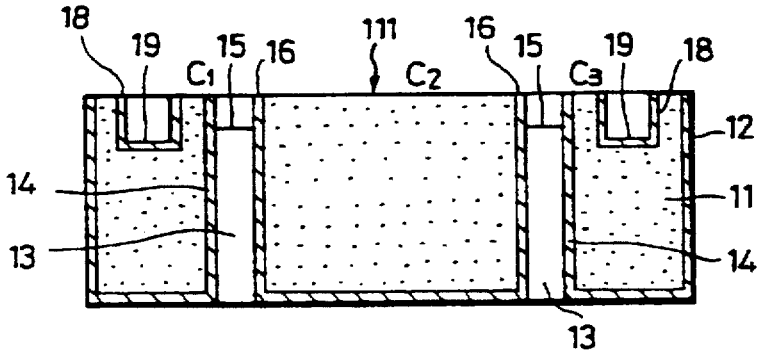
FIG. 18 is a cross-sectional view taken along the line XVIII—XVIII in FIG. 17.
Figure 19:
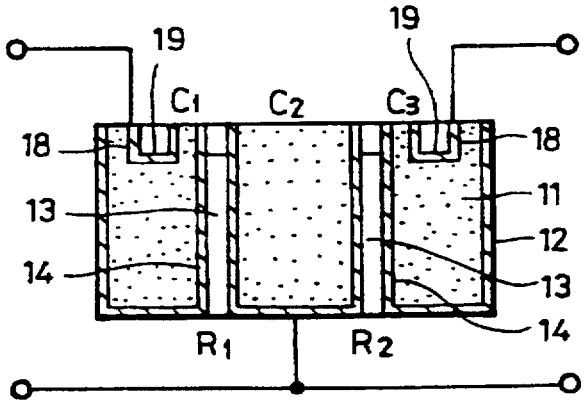
FIG. 19 is a diagram showing an arrangement of a dielectric filter according to the present invention.

According to the embodiment of the present invention, as shown in FIGS. 17, 18 and 19, second recesses 19 are respectively formed between the electrodes 16 of the recesses 15 of the two resonators $R_1$, $R_2$ and the outer conductor 12 on the major surface 111 of the dielectric block 11 with predetermined spacings between them and the electrodes 16. Then, a predetermined electrostatic capacitance is produced between the recesses 15 of the resonators $R_1$, $R_2$ and the electrodes 16 by forming electrodes 18 within the second recesses 19 at the same time when the conductors 12, 14 are formed similarly as described above. As shown in FIG. 19, input and output terminals are led out from these electrodes 18 and the input and output coupling capacitances $C_1$ and $C_3$ are constructed by the electrostatic capacitance produced between the recesses 15 and the electrodes 16.

With this arrangement, the external input and output coupling capacitances $C_1$, $C_3$ can be omitted. Further, if the dielectric filter having this configuration is further constructed as shown in FIG. 14, then it is possible to remove all the external capacitors $C_1$ to $C_3$.

Figure 22:
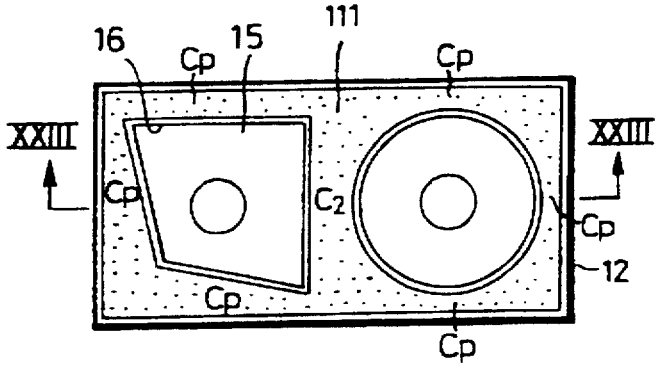
FIG. 22 is a top view showing a di electric filter according to another embodiment of the present invention.
Figure 23:
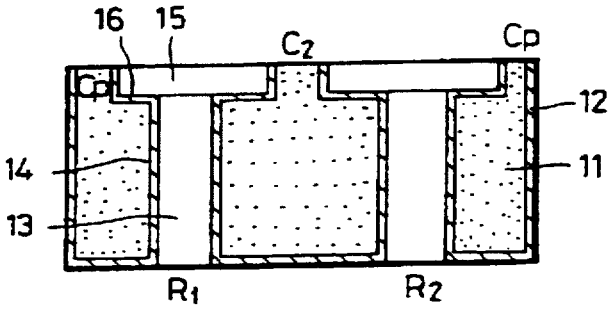
FIG. 23 is a cross-sectional view taken along the line XXIII—XXIII in FIG. 22.

Further, according to the embodiment of the present invention, as shown in FIGS. 22 and 23, if the recesses 15 and the electrodes 16 constructing the additional capacitance Cp relative to the dielectric resonators $R_1$, $R_2$ are modified in shapes such that the lengths of the recesses 15 and the electrodes 16 are changed at their portions parallel to the through-holes 13 of the outer conductor 12, then it is possible to adjust the resonance frequencies of the dielectric resonators $R_1$, $R_2$.

Specifically, if the resonance frequency $f_0$ of the dielectric resonator is expressed by a lumped constant, then with the additional capacitance Cp and the equivalent capacitance C and the equivalent inductance L determined by the diameter of the through-hole 13 and the outer diameter and the height of the through-hole direction of the dielectric block, $$f_0 = \frac{1}{2\pi\sqrt{L \cdot C \cdot Cp}} \ (H_z)$$

Therefore, the resonance frequency $f_0$ is lowered as the additional capacitance Cp is increased (the resonance frequency $f_0$ is increased as the additional capacitance Cp is decreased).

Further, if a dielectric constant provided between the electrodes is taken as $\epsilon$, an opposing area of the electrodes is taken as S and a spacing between the electrodes is taken as d, then the value of the electrostatic capacitance C is expressed as:

$$C = \epsilon \frac{S}{d}$$

Accordingly, when the electrode area is reduced by the same amount, the change of the electrostatic capacitance is large if the spacing between the electrodes is narrow.

Figure 24:
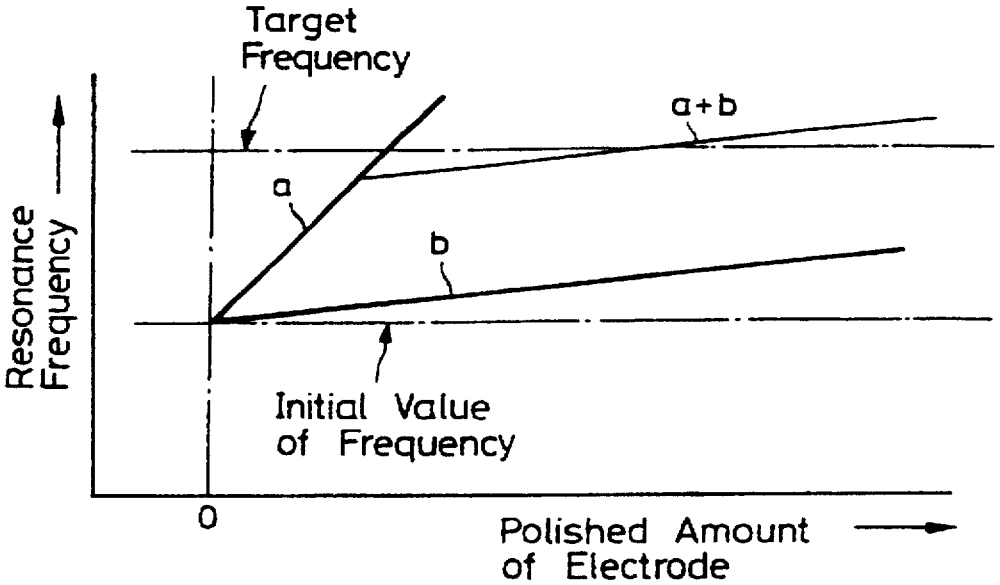
FIG. 24 is a diagram showing characteristic curves obtained when the recess in which the additional capacitance is constructed and the electrode are shaped as shown in FIGS. 22 and 23.
Figure 25A:
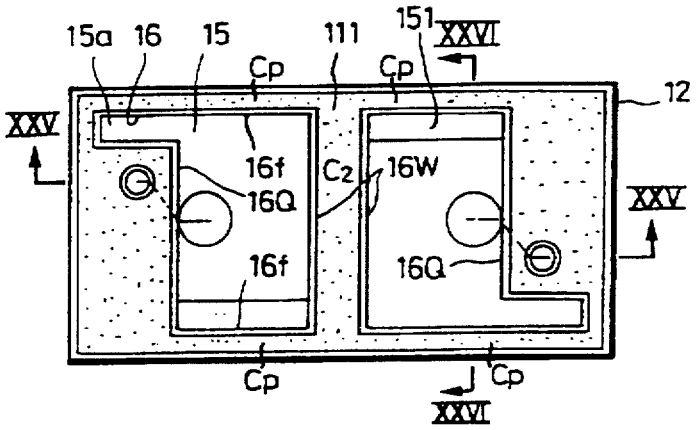
FIG. 25A is a top view showing a dielectric filter according to another embodiment of the present invention.
Figure 25B:
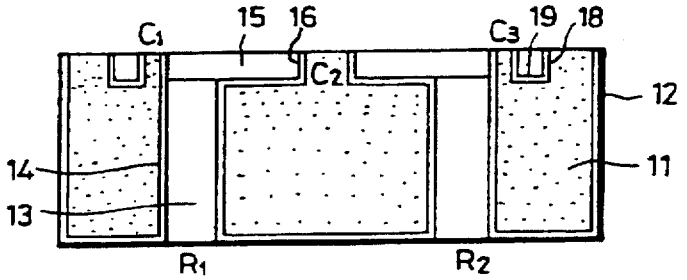
FIG. 25B is a cross-sectional view taken along the line XXV—XXV in FIG. 25A.
Figure 25C:
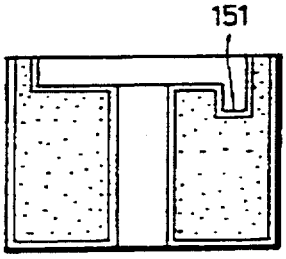
FIG. 25C is a cross-sectional view taken along the line XXVI—XXVI in FIG. 25A.
Figure 25D:
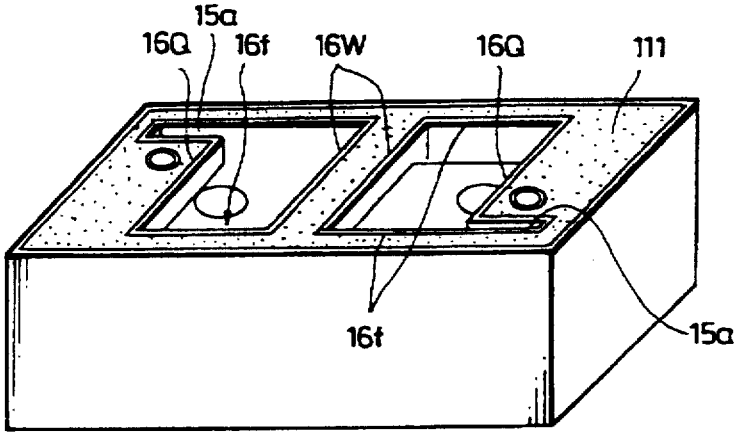
FIG. 25D is a perspective view of the dielectric filter shown in FIGS. 25A to 25C.

Thus, when the recesses 15 and the electrodes 16 constructing the additional capacitance Cp are shaped as shown in FIGS. 22 and 23, the changing ratio of the additional capacitance Cp is large with respect to the electrode of the narrow spacing and the changing ratio of the resonance frequency also is large as shown by a characteristic curve a in FIG. 24. Therefore, it is possible to adjust the resonance frequency in a wide range.

Conversely, when the electrode is cut at its wide portion, the changing ratio of the additional capacitance Cp is small and the changing ratio of the resonance frequency also is small as shown by a characteristic curve b with the result that the resonance frequency can be fine adjusted.

Therefore, according to the arrangement shown in FIGS. 22 and 23, the resonance frequency can be coarsely or fine adjusted on the basis of the place where the electrode 16 opposing the outer conductor 12 is cut as shown by a characteristic curve a+b in FIG. 24. Thus, the resonance frequency can be adjusted in a short period of time with high accuracy.

FIGS. 25A through 25D show another embodiment of the present invention. In FIGS. 25A through 25D, like parts corresponding to those of FIGS. 12, 13, FIGS. 17, 18 and FIGS. 20, 21 are marked with the same references and therefore need not be described in detail.

According to this embodiment, as shown in FIGS. 25A through 25D, in order to change the additional capacitance Cp relative to the dielectric resonators $R_1$, $R_2$, the recesses 15 and the electrodes 16 are shaped such that electrode portions **16*f* opposing only the outer conductor 12 are respectively formed wide, electrode portions 16W opposing only the adjacent resonators $R_1$, $R_2$ are respectively formed wide, electrode portions 16Q opposing only the electrode 18 which serves as the input and output terminal are formed and the ancillary recess portions 15*a*** are formed in order to relatively reduce the coupling capacitance with respect to other electrodes than the target electrode.

It is customary that a high accuracy composite dielectric filter should be adjusted in frequency, band width and selectivity when manufactured. In actual practice, the frequency, the band width and the selectivity of the composite dielectric filter are adjusted by locally decreasing the thickness of the electrode by some suitable means, such as polishing or the like. In general, these adjustments affect each other and it is very difficult for the user to determine where and how much to adjust the composite dielectric filter. Therefore, the adjustment becomes considerably troublesome and is low in yield.

When however the dielectric filter is constructed as shown in FIGS. 25A through 25D, it is possible to change only the ground capacity by cutting the portions of the electrode portions **16*f* of the recesses 15 opposing the outer conductor (ground electrode) 12**. In this case, the coupling capacitance produced between the resonators $R_1$ and $R_2$ and the input and output coupling capacitances are not changed substantially. This is equivalent to the case that the resonance frequencies of the resonators $R_1$ and $R_2$ are adjusted. Thus, only the frequency at which the filter is driven is mainly adjusted and the band width and the selectivity are not changed.

If the electrode portions 16W of the recesses 15 opposing only the adjacent resonators $R_1$, $R_2$ are cut out, then this is equivalent to the case that only the coupling capacitance produced between the resonators $R_1$ and $R_2$ is changed and only the coupling capacitance $C_2$ is changed. Thus, the ground capacity and the input and output coupling capacitances are not changed substantially, and therefore only the band width is mainly adjusted and the frequency and the selectivity are not changed.

If the electrode portions 16Q of the recesses 15 opposing only the electrode 18 constructing the input and output terminal are cut out, this is equivalent to the case that only the input and output coupling capacitances $C_1$, $C_3$ are changed. Thus, the ground capacity and the coupling capacitances produced between the resonators $R_1$, $R_2$ are not changed substantially. Therefore, only the selectivity is mainly adjusted and the frequency and the band width are not changed.

Accordingly if the dielectric filter is arranged as shown in FIGS. 25A through 25D, it is possible to separately adjust the respective adjustment items, such as the frequency, the band width and the selectivity of the dielectric filter.

Figure 26:
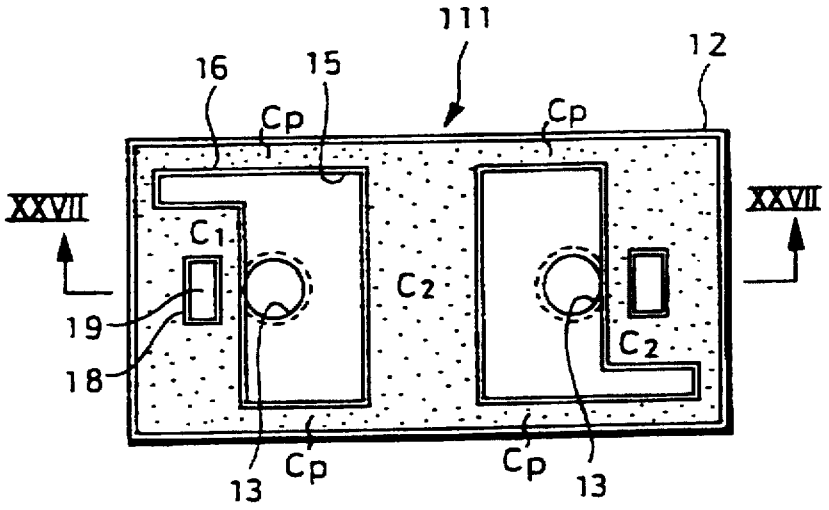
FIG. 26 is a top view showing a dielectric filter according to another embodiment of the present invention.
Figure 27:
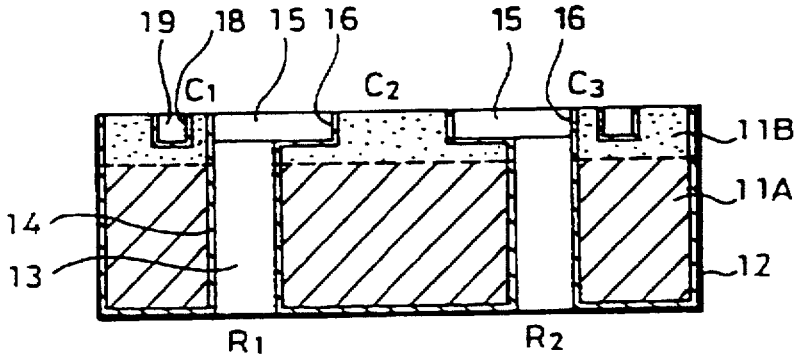
FIG. 27 is a cross-sectional view taken along the line XXVII—XXVII in FIG. 26.

FIG. 26 is a top view showing another embodiment of the present invention, and FIG. 27 is a cross-sectional view taken along the line XXVII—XXVII in FIG. 26. In FIGS. 26 and 27, like parts corresponding to those of FIGS. 12, 13 and FIGS. 17, 18 are marked with the same references and therefore need not be described in detail.

According to this embodiment, as shown in FIGS. 26, 27, a dielectric block is composed of a double layer structure of dielectrics 11A and 11B in which a dielectric constant $\epsilon_B$ of the dielectric 11B on the side in which the additional capacitance Cp for the dielectric resonators $R_1$, $R_2$ of the dielectric block 11 and the electrode 18 connected to the input and output terminal are formed is selected to be lower than a dielectric constant $\epsilon_A$ of the dielectric body 11A.

In this case, in the dielectric block 11, the dielectric 11B is formed of a (Ca, Sr, Ba) $(Zr, Ti)O_3$ dielectric ceramics whose dielectric constant is 30. On the other hand, the dielectric 11A is formed of $CaO—La_2O_3—TiO_2$ dielectric ceramics whose dielectric constant is 100. Then, powders of respective materials are laminated to form a double-layer and molded, whereafter it is sintered at 1330° C. for five hours, thus the dielectric block 11 being obtained.

The electrostatic capacitance values of the input and output coupling capacitances $C_1$, $C_3$ of the dielectric filter are changed variously by designing. The electrostatic capacitance C is given, as earlier noted, by the following equation:

$$C=\epsilon\frac{S}{d}$$

Therefore, if the dielectric with a low dielectric constant is used, then it is sufficient that the area S is widened or the spacing d is reduced in order to obtain the same capacitance.

When the recess 19 for the input and out terminal is formed in the dielectric block 11 in actual practice, the size and position of the recess 19 are physically limited to a certain range. When a capacitance of $0.1\times10^{-12}$ F is realized by a material with a specific inductive capacitance $\epsilon=100$, if the area S is a practical area, i.e., 2 $mm^2$, then the spacing d becomes 17 mm, which cannot be realized physically. Conversely, if the spacing d is a practical one, i.e., 2 mm, then the area S becomes 0.2 $mm^2$, which cannot be realized physically. However, if the material with a dielectric constant $\epsilon=20$ is used, when the area S is 2 $mm^2$, the spacing d becomes 3 mm. When the spacing d is 2 mm, then the area S becomes 1 $mm^2$ which is sufficient enough in actual practice.

In order to miniaturize the dielectric resonator, it is necessary that the dielectric constant $\epsilon$ should be selected to be high. Accordingly, if the dielectric filter is arranged as shown in FIGS. 26 and 27, then the size of the electrode 18 to which the input and output terminal are connected can be made sufficient one in practice without changing the size of the whole arrangement.

Figure 28:
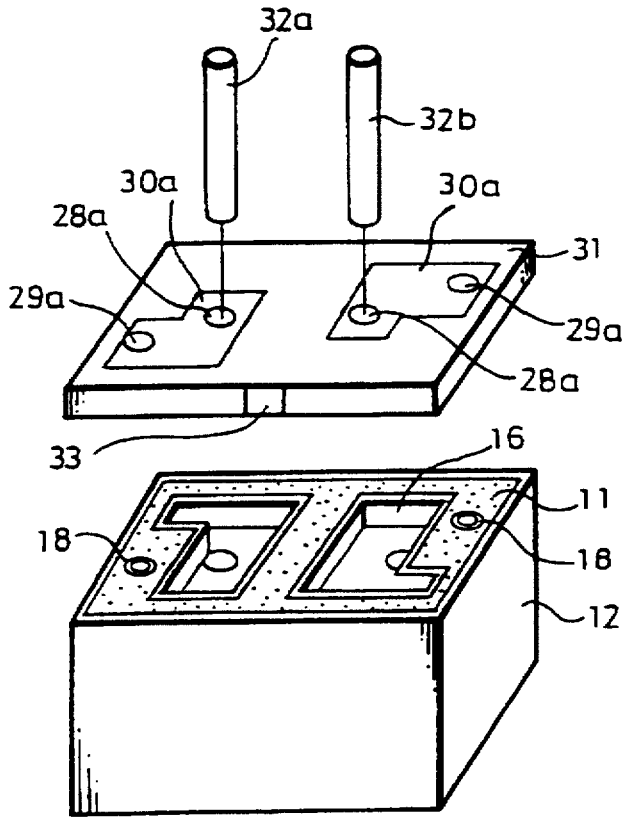
FIG. 28 is an exploded perspective view showing a specific example of a dielectric filter according to the present invention.
Figure 29:
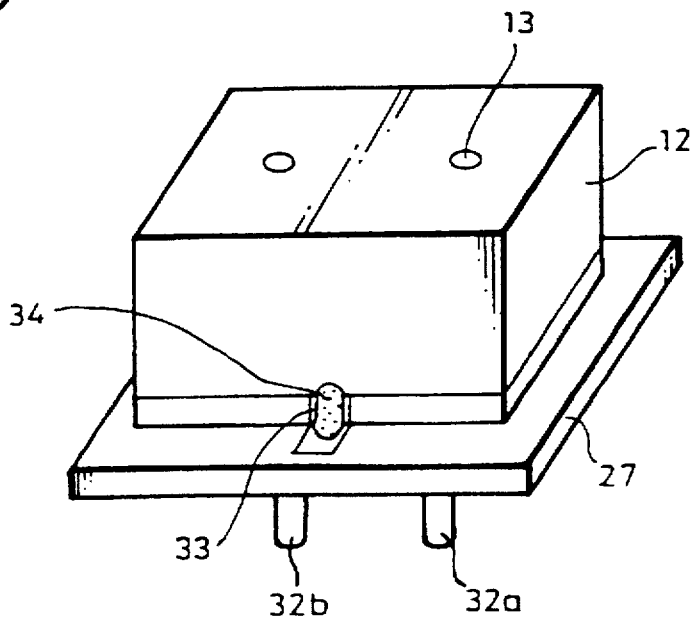
FIG. 29 is a perspective view showing an example that the dielectric filter shown in FIG. 28 is mounted on a mount substrate.

The dielectric filter shown in FIGS. 25, 26 and 27 is attached to a mount substrate 27 as shown in FIGS. 28, 29. Specifically, as shown in FIG. 28, a substrate 31 includes terminal pin holes 28*a*, 29*b*, through-holes 29*a*, 29*b* in which upper and lower continuous conductors are provided in order to electrically be connected to the input and output terminal electrodes 18 and conductive patterns 30*a*, for connecting the through-holes 29*a*, and the terminal pin holes 28*a*. This substrate 31 is attached to the dielectric filter at its surface on which the input and output terminal electrodes 18 are attached by some suitable means, such as an adhesive or the like.

The input and output terminal electrodes 18, 18 and the through-holes 29*a*, of the substrate 31 are electrically connected with each other by soldering. Terminal pins 32*a*, 32*b* are fitted into the terminal pin holes 28*a*, of the substrate 31 with pressure and then soldered. Thus, it is possible to obtain the dielectric filter in which the terminal pins 32*a*, 32*b* and the input and output terminal electrodes 18, 18 of the dielectric filter are electrically connected to each other.

This dielectric filter is electrically and mechanically attached to the mount substrate 27 by means of the terminal pins 32*a*, 32*b* as shown in FIG. 29. In this case, the outer conductor 12 of the dielectric filter is connected to the mount substrate 27 through a side wall conductor pattern 33 formed on the side wall of the substrate 31 by means of a solder 34 in the form of an earth pattern.

When the dielectric filter is attached to the mount substrate 27 as shown in FIGS. 28 and 29, the dielectric filter can be used without an input and output leader and the shield case.

Figure 30:
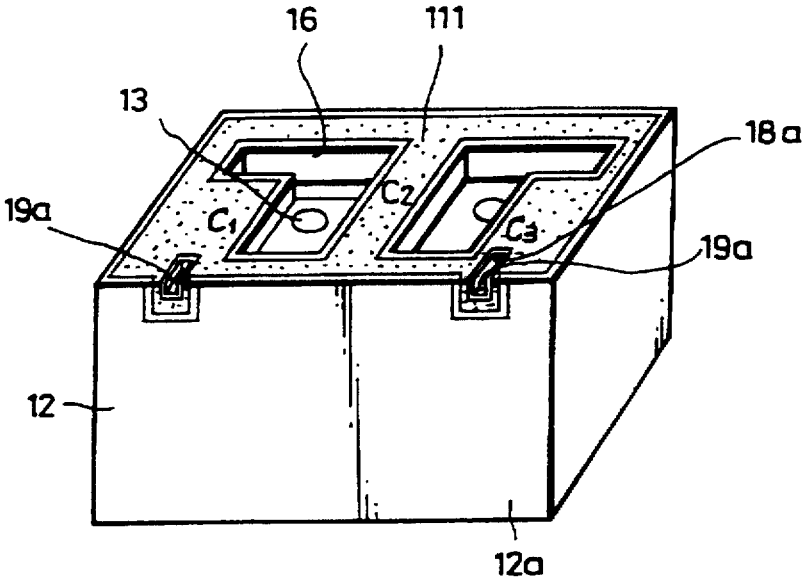
FIG. 30 is a perspective view showing a dielectric filter according to a further embodiment of the present invention.
Figure 31:
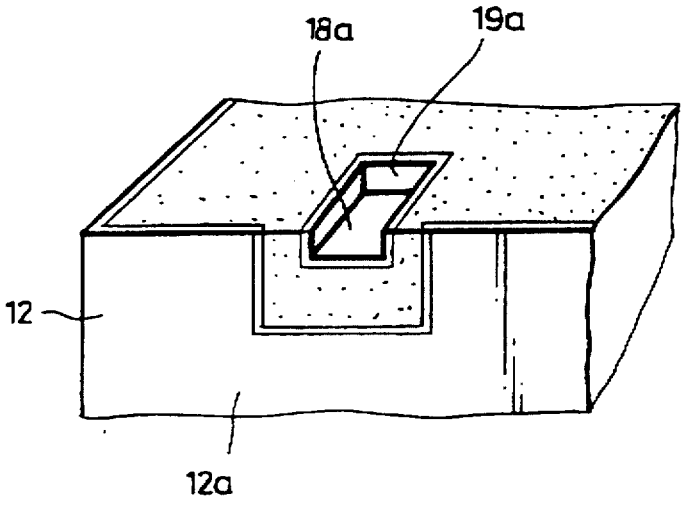
FIG. 31 is an enlarged perspective view showing a main portion of the dielectric filter shown in FIG. 30.
Figure 32:
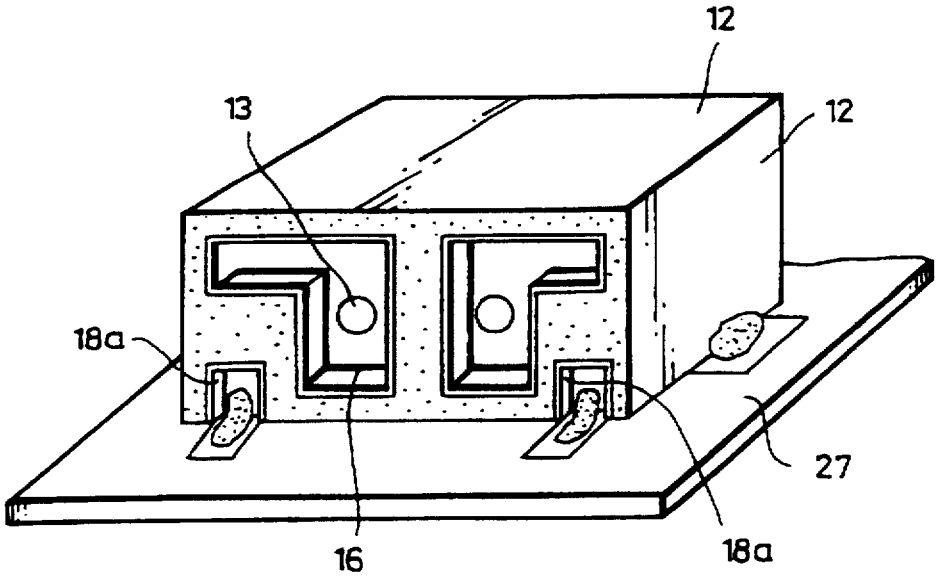
FIG. 32 is a perspective view showing an example that the dielectric filter according to the present invention is mounted on a mount substrate.

FIGS. 30, 31 and 32 show the case that the dielectric filter according to the above-mentioned embodiment is surface-mounted on the mount substrate 27. In FIGS. 30, 31 and 32, like parts corresponding to those of FIGS. 12, 17, 18, 20, 21, 28 and 29 are marked with the same references and therefore need not be described in detail.

According to this embodiment, as shown in FIGS. 30 and 31, slits 19*a* which are extended to one side surface 12*a* are formed on the dielectric block 11 at its side surface in which the additional capacitance Cp for the dielectric resonators $R_1$, $R_2$ is formed. Electrodes 18*a* are formed on the insides of the slits 19*a* and the input and output capacitances $C_1$ and $C_3$ are formed between the electrodes 18*a*, 18*a* and the electrode 16 of the recess 15.

Moreover, as shown in FIG. 31, the outer conductor 12 on one side surface 12 is removed at its portion around the slit 19*a*. A rest of the arrangement is similar to that of the above-mentioned embodiments.

When the dielectric filter according to the embodiment shown in FIG. 30 is surface-mounted on the mount substrate 27, one side surface 12*a* of the dielectric filter is used as a lower surface and disposed at a predetermined position of the mount substrate 27. Then, the electrodes 18*a* of the dielectric filter are mounted on the mount substrate 27 by soldering in a predetermined interconnection pattern, and the predetermined position of the outer conductor 12 is soldered to the predetermined position of the mount substrate 27.

According to the aforesaid embodiment, assembly parts constructing the dielectric filter can be removed except the dielectric block 11 and the dielectric filter can be surface-mounted on the mount substrate 27 as shown in FIG. 32. Further, since the dielectric filter electrodes 18*a* according to this embodiment are connected directly to the mount substrate 27, the occurrence or influence of electromagnetic wave is small so that the shield case can be removed.

Figure 33:
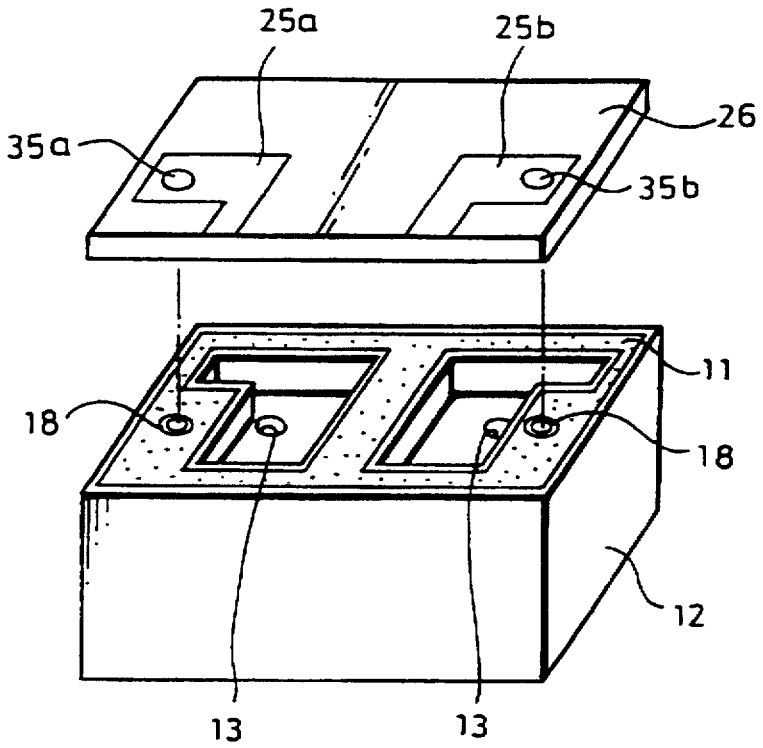
FIG. 33 is an exploded perspective view showing a dielectric filter according to a further embodiment of the present invention.
Figure 34:
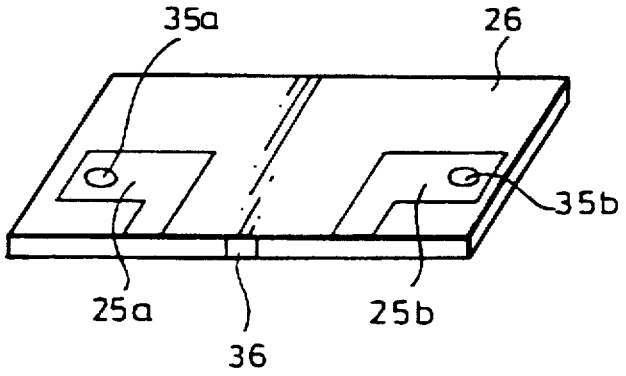
FIG. 34 is a perspective view showing other example of a main portion of the dielectric filter shown in FIG. 33.
Figure 35:
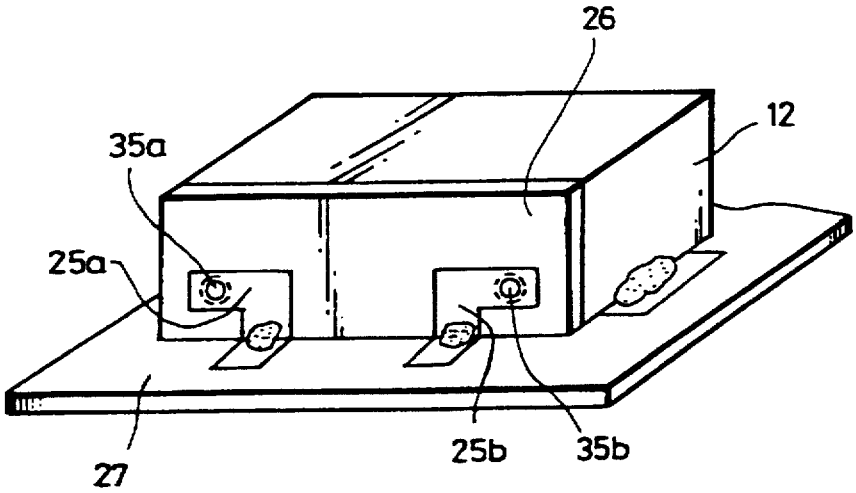
FIG. 35 is a perspective view showing an example that the dielectric filter shown in FIG. 33 is mounted on a mount substrate.

FIGS. 33, 34 and 35 show the case that the dielectric filters shown in FIGS. 25A through 25D and FIGS. 26, 27 are mounted on the mount substrate 27 by means of a face mount substrate 26.

As shown in FIG. 33, the face mount substrate 26 includes through-holes 35*a*, 35*b* having conductors formed on the upper and lower portions of the substrate 26 for conducting the input and output terminal electrodes 18 of the dielectric filter and conductive patterns 25*a*, 25*b* extended to one side edge or the substrate 26 so as to be electrically connected to the through-holes 35*a*, 35*b*.

The face mount substrate 26 is attached to the dielectric block 11 at its surface in which the input and output terminal electrode 18 is formed with a predetermined positional relationship by some suitable means, such as an adhesive or the like. Also, the electrodes 18, 18 and the through-holes 35*a*, 35*b* of the face mount substrate 26 are electrically connected by soldering.

When the dielectric filter to which the face mount substrate 26 is attached is surface-mounted on the mount substrate 27, as shown in FIG. 35, the face mount substrate 26 is disposed at a predetermined position of the mount substrate 27 such that it is directed in the front and extended side edge sides of the conductor patterns 25*a*, 25*b* are directed in the lower side. The conductor patterns 25*a*, 25*b* of the face mount substrate 26 are attached to predetermined interconnection patterns of the mount substrate 27 by soldering. Also, the outer conductor 12 of the dielectric filter is soldered at its predetermined position to a predetermined ground pattern of the mount substrate 27.

In this case, as shown in FIG. 34, a conductor pattern 36 is formed on the side surface of the central portion of the face mount substrate 26. Then, it is possible to increase a strength with which the face mount substrate 26 is attached to the dielectric filter by soldering the conductor pattern 36 and the outer conductor 12 of the dielectric filter.

Figure 36:
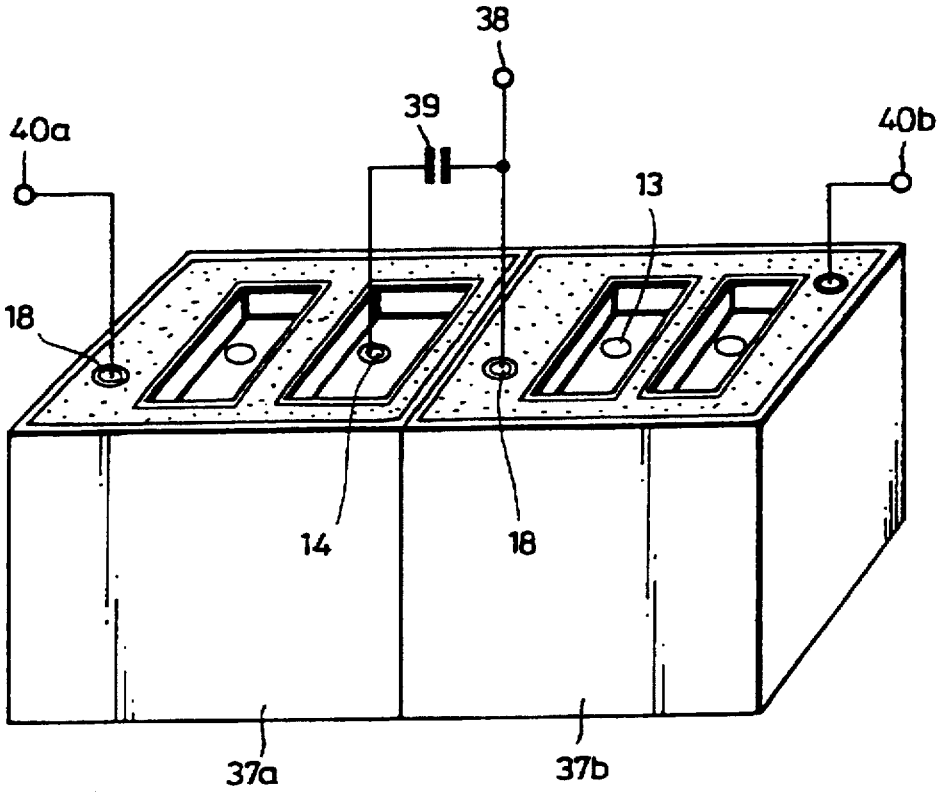
FIG. 36 is a perspective view showing an example that the dielectric filter according to the present invention is applied to a duplexer.

When the dielectric filter is used as the duplexer, i.e., the antenna device for transmitter-receiver, as shown in FIG. 36, two dielectric filters 37*a*, 37*b* with center frequencies different from predetermined one are bonded to each other so that their sides on the additional capacitance Cp side are directed in the same direction, a common terminal 38 connected to the antenna is connected to the input terminal electrode 18 of the dielectric filter 37*b*, the common terminal 38 is connected to the inner conductor 14 of one resonator $R_2$ of the dielectric filter 37*a* through an external capacitor 39, an input terminal 40*a* connected to the input terminal electrode 18 of the dielectric filter 37*a* is connected to the output side of the transmitter, and an output terminal 40*b* connected to the output terminal electrode 18 of the dielectric filter 37*b* is connected to the input side of the receiver.

Figure 37:
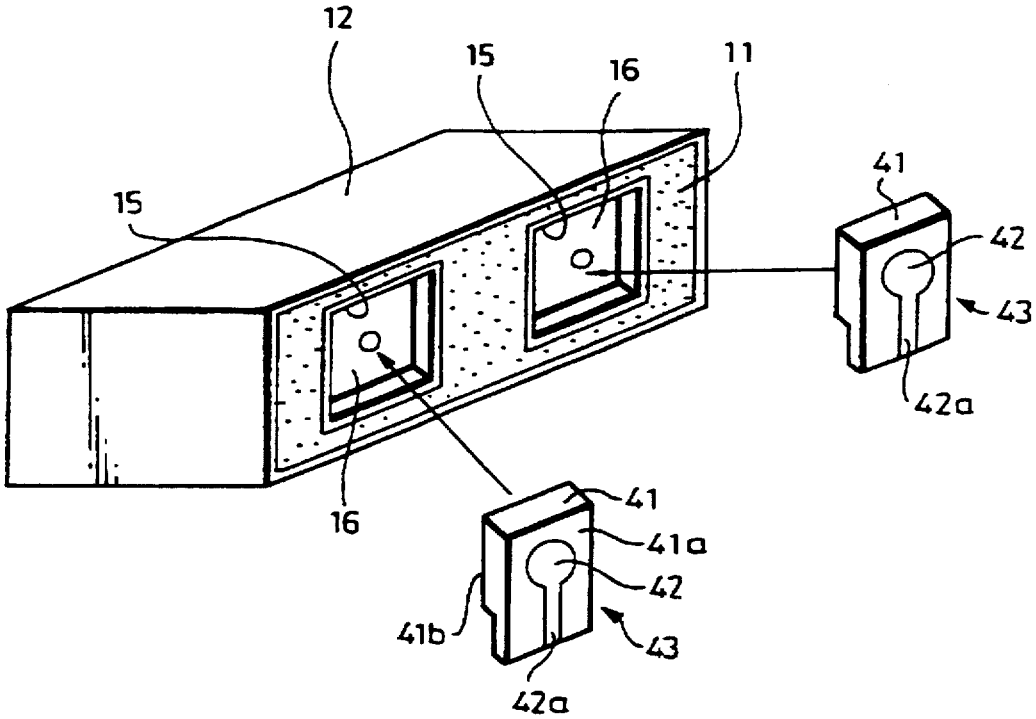
FIGS. 37 and 38 are perspective views showing a dielectric filter according to a further embodiment of the present invention.
Figure 38:
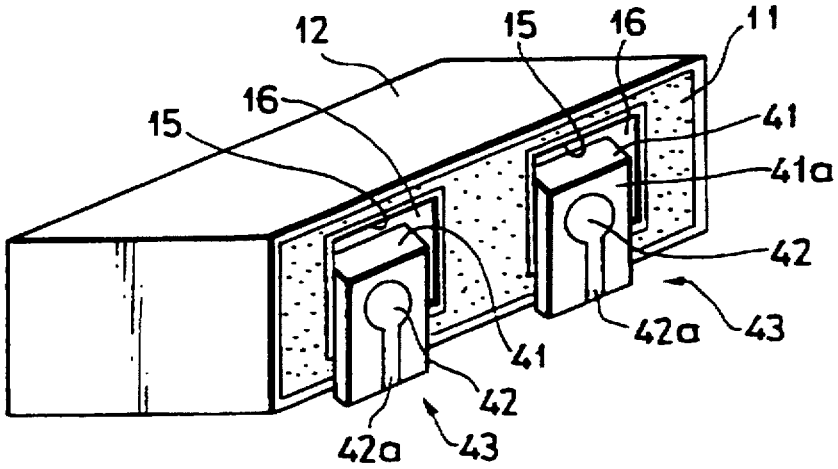

FIGS. 37 and 38 show a further embodiment of the present invention. In FIGS. 37 and 38, elements and parts identical to those of the preceding embodiments are marked with the same reference numerals.

According to this embodiment, the input and output coupling capacitances $C_1$, $C_3$ are formed in the recesses 15 formed on the dielectric block 11. Specifically, as shown in FIGS. 37 and 38, an electrode 42 is formed on one surface (terminal surface) 41*a* of a substrate 41 made of a dielectric ceramics and served as a capacitor member 43. In this case, the electrode 42 is extended to one edge portion of the substrate 41 and served as an input and output terminal portion 42*a*. Then, the substrate 41 is attached at its surface in which the electrode 42 is not formed to the electrodes 16 of the respective recesses 15. Thus, the input and output coupling capacitances $C_1$, $C_3$ are formed between the electrode 16 of the recess 15 and the electrode 42 of the substrate 41.

As the dielectric ceramics, there can be used the same material as that used in the dielectric block 11, for example. In this case, a stepped portion is formed on another surface (attachment surface) 41*b* so that the substrate 41 can be accommodated in the recess 15.

FIGS. 39A through 39D and FIGS. 40A through 40D show examples of the capacitor member 43 used in the embodiment according to the present invention.

Figure 39A:
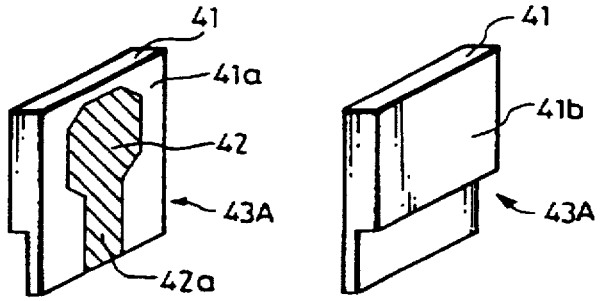
FIGS. 39A through 39D are perspective views showing examples of capacitor members used in the embodiments according to the present invention, respectively.

In the case of a capacitor member 43A shown in FIG. 39A, the input and output electrode 42 is formed on the terminal surface 41*a* of the substrate 41 corresponding to the size of each recess 15. The attachment surface 41*b* in which the electrode 42 is not formed and the electrode 16 of the recess 15 are secured together by an adhesive.

Figure 39B:
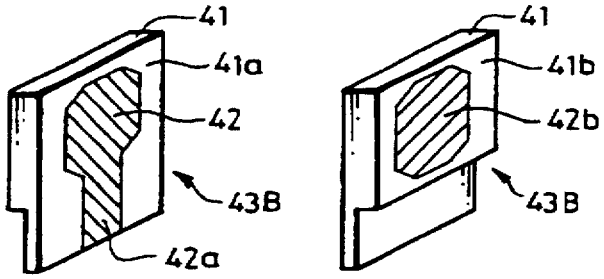

In the case of a capacitor member 43B shown in FIG. 39B, the electrodes 42*a*, 42*b* are formed on both surfaces of the substrate 41. Then, the electrode 42*b* formed on the attachment surface 41*b* and the electrode 16 of the recess 15 are secured together by soldering.

Figure 39C:
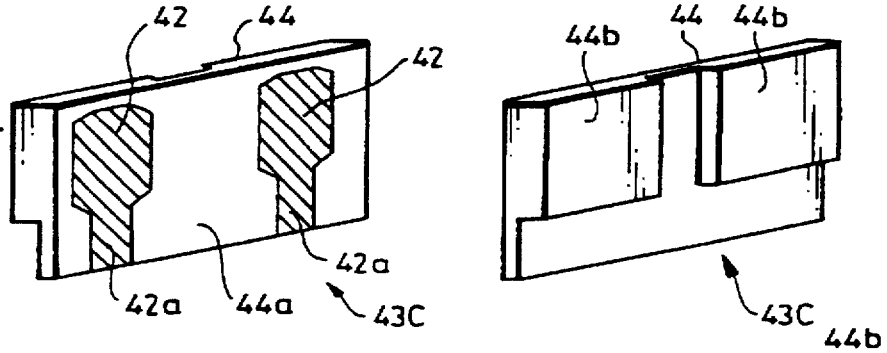
Figure 39D:
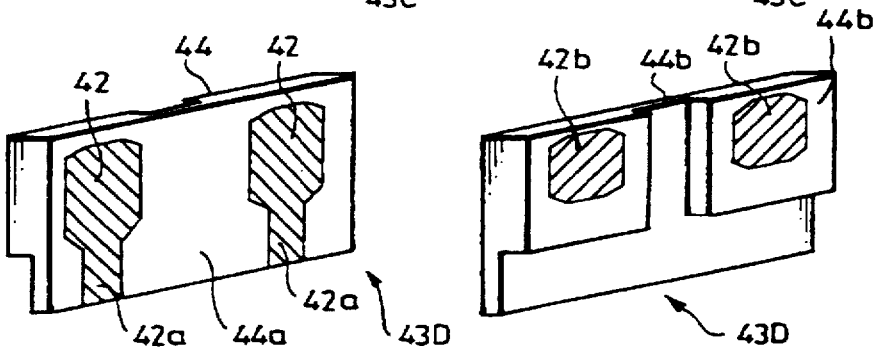

In the case of a capacitor member 43C shown in FIG. 39C, the two electrodes 42 are formed on a terminal surface 44*a* of one substrate 44 having an area larger than the substrate 41 shown in FIGS. 38A, 38B. Then, the attachment surface 44*b* of the substrate 44 and the electrode 16 of the recess 15 are secured together by an adhesive.

In the case of a capacitor member 43D, the two electrodes 42 are formed on the terminal surface 44*a* of one substrate 44 similarly to FIG. 39C, and the two electrodes 42*b* are also formed on the attachment surface 44*b*. Then, the electrode 42*b* formed on the attachment surface 44*b* of the substrate 44 and the electrode 16 of the recess 15 are secured together by soldering.

In capacitor members 43E to 43H shown in FIGS. 40A to 40D, a series-connected capacitor is constructed by laminating two substrates made of dielectric substrates.

Figure 40A:
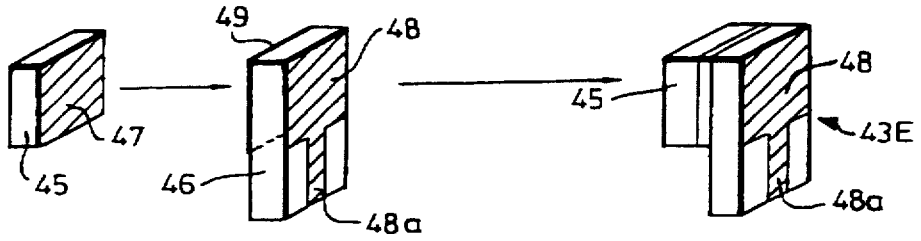
FIGS. 40A through 40D are perspective views showing examples of capacitor members used in the embodiments according to the present invention, respectively.

In the case of the capacitor member 43E shown in FIG. 40A, a square-shaped substrate 45 in which an electrode 47 is formed on at least one surface and rectangular substrate 46 in which electrodes 48, 49 are formed on both surfaces are joined together by soldering. In this case, an electrode 48 is extended as a terminal portion 48*a*. When the electrode is not formed on the other surface of the substrate 45, the electrodes 48, 49 are secured to the electrodes 16 of the recesses 15 by an adhesive. When the electrode is formed on that surface, the electrodes 48, 49 are secured to the electrodes 16 of the recesses 15 by soldering.

Figure 40B:
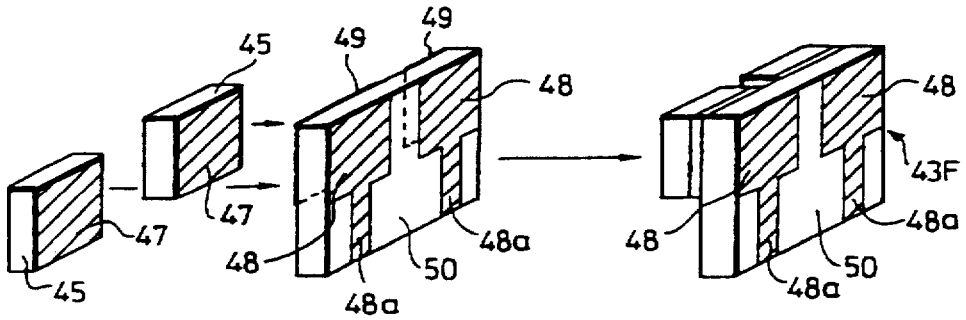

In the case of the capacitor member 43F shown in FIG. 40B, two electrodes 48 are formed on both surfaces of the substrate 45 and the substrate 45 shown in FIG. 40A is attached to each of the electrodes 49 formed on one surface.

Figure 40C:
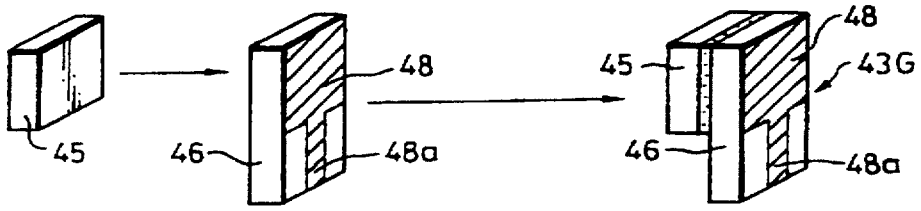

In the case of the capacitor member 43G shown in FIG. 40C, a rectangular substrate 46 in which the electrode 48 is formed on one surface and the square substrate 45 are secured together by an adhesive. Electrodes may not be formed on the other surface of the substrate 45. The capacitor member 43G is secured to the electrode 16 of each recess 15 by soldering or adhesive.

Figure 40D:
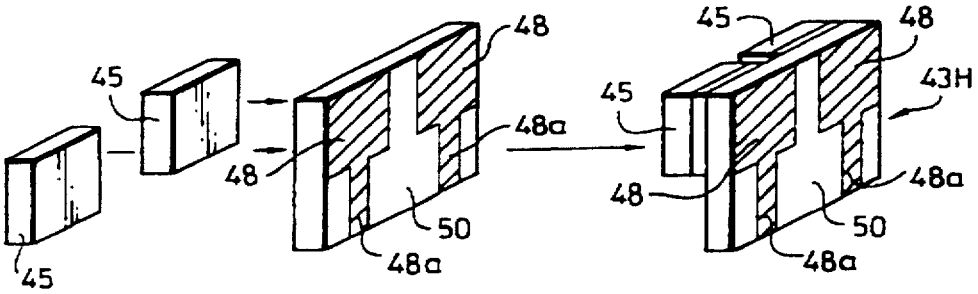

In the case of the capacitor member 43H shown in FIG. 40D, the two electrodes are formed on one surface of a single substrate 50 and the substrate 45 shown in FIG. 40D is secured to the other surface by an adhesive.

Figure 41:
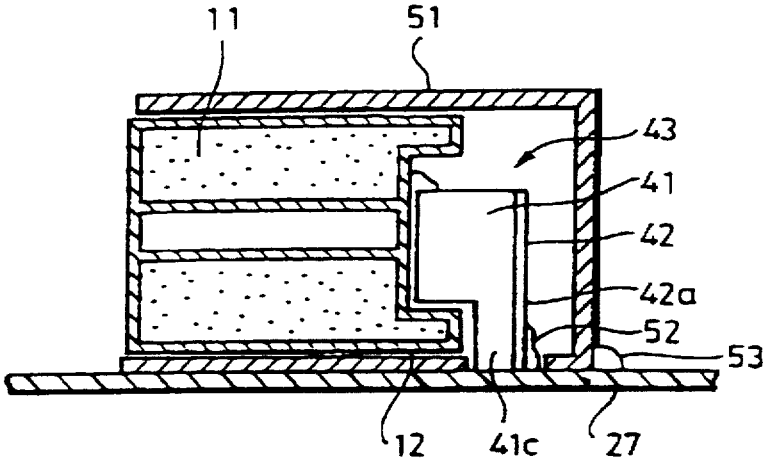
FIG. 41 is a cross-sectional view showing an example that the dielectric filter shown in FIG. 37 is mounted on a mount substrate.

FIG. 41 shows the state that the dielectric filter according to this embodiment is in use. As shown in FIG. 41, a shield case 51 is soldered to the dielectric block 11 to which the capacitor member 43 is secured by soldering or adhesive. When the capacitor member 43 is secured to the dielectric block 11, the terminal portion 41*c* is projected from the surface of the outer conductor 12. Then, the dielectric block 11 is secured to the mount substrate 27 by soldering. In this case, the terminal portion 42*a* of the capacitor member 43 and the input and output terminal mount pattern are connected together by a solder 52. The shield case 51 and the filter ground mount pattern are connected together by a solder 53.

According to the dielectric filter thus arranged of this embodiment, since the input and output coupling capacitances $C_1$, $C_3$ are constructed by disposing the capacitor member 43 in which the electrode 42 is formed on at least one surface in a plurality of recesses 15 of the dielectric block 11, the external coupling capacitor can be removed and the dielectric filter can be miniaturized and the number of assembly parts thereof can be reduced. Moreover, the dielectric filter according to the present invention can be made inexpensive. In addition, according to this embodiment, since the electrode 42 constructing the coupling capacitances $C_1$, $C_3$ is served also as the input and output terminal portion 42*a*, the dielectric filter can be surface-mounted on the mount substrate 27 by a simplified arrangement.

Furthermore, according to this embodiment, since the electrode 42 constructing the coupling capacitances $C_1$, $C_3$ can be exposed, unlike the case that commercially-available chip capacitors are used, it is possible to adjust the coupling capacitances $C_1$, $C_3$ with ease by removing the electrode 42 even after the capacitor member 43 is connected to the dielectric block 11.

Figure 42:
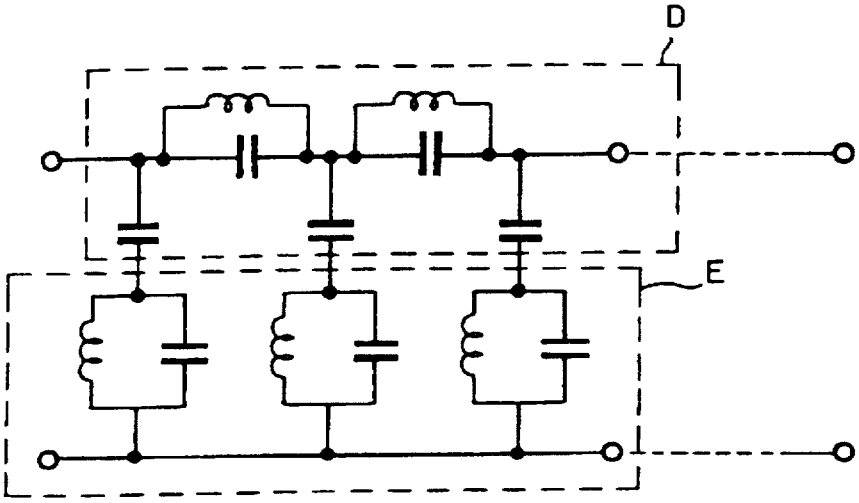
FIG. 42 is a diagram showing a circuit arrangement of a band elimination filter.

FIG. 42 is a diagram showing a circuit arrangement of a band elimination filter. The dielectric filter according to the present invention can also be applied to such band elimination filter. A portion shown by reference symbol D in FIG. 42 is composed of capacitor members shown in FIGS. 43A through 43C, and a portion shown by reference symbol E in FIG. 42 is constructed by using the above-mentioned dielectric filter 11.

Figure 43A:
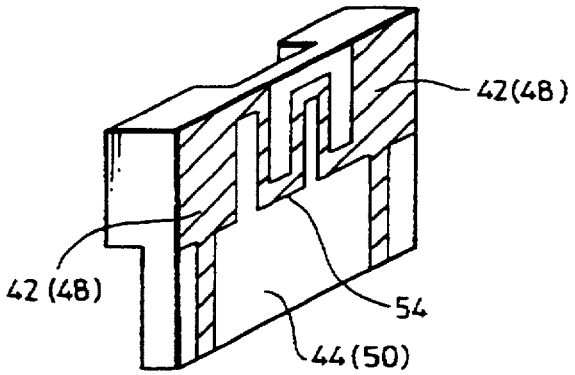
FIG. 43A is a perspective view showing another example of a capacitor member.
Figure 43B:
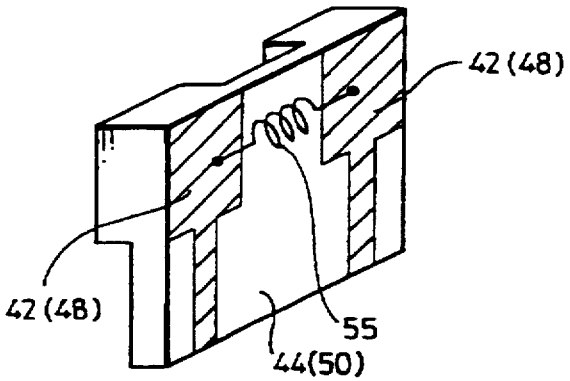
FIG. 43B is a perspective view showing a further example of a capacitor member.
Figure 43C:
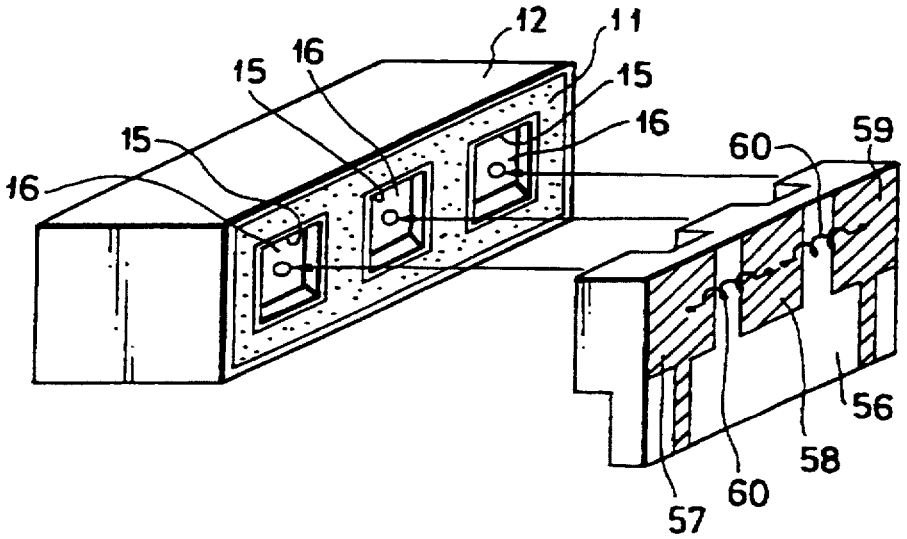
FIG. 43C is a perspective view showing another example of a band elimination filter.

FIGS. 43A through 43C show examples of capacitor members according to the embodiment of the present invention.

Since the band elimination filter needs a coil connected between the resonators, according to this embodiment, a coil is connected between the electrodes 42 (48) by using the capacitor member in which the input and output terminal electrode 42 (48) is formed on a single plate-shaped substrate 44 (50) (see FIGS. 39C, 39D and FIGS. 40B, 40D). In this case, a coil 54 may be formed by a coil pattern as shown in FIG. 43A. Alternatively, a coil 55 may be formed by a conductor as shown in FIG. 43B.

Since the coil 54 or 55 is connected between the electrodes 42 (48) as described above, it is possible to construct the band elimination filter without using a conventional repeating substrate. Therefore, the band elimination filter can be miniaturized, reduced in assembly parts and made inexpensive.

Specifically, as shown in FIGS. 43C, the three recesses 15 and the three electrodes 16 are formed on the dielectric block 11 and electrodes 57, 58 and 59 are formed on a single substrate 56. These electrodes 57, 58 and 59 are connected by a coil 60 and the substrate 56 is attached to the recesses 15.

According to the present invention, since the recesses 15 are formed on the dielectric block 11 in which a plurality of dielectric resonators $R_1$, $R_2$ are formed and the electrodes 16 connecting the central conductor are formed in the recesses 15, the ground electrode area of the side (drive terminal side) in which the inner conductor 14 and the outer conductor 12 are not electrically connected is increased, which becomes equivalent to the case that the additional capacitance Cp is provided.

Therefore, the capacitance value of the additional capacitance Cp can properly be set by selecting the depth, the shape and the area of the recess 15, whereby the lengths of the resonators $R_1$, $R_2$ can be reduced, accordingly, the thickness of the dielectric block 11 can be reduced. Thus, it is possible to miniaturize the dielectric filter.

According to the present invention, since the second recess 19 is formed on the dielectric block 11 at its side in which the additional capacitance Cp is constructed, the electrode 18 is constructed within the recess 19 and the coupling capacitances $C_1$, $C_3$ are constructed between the electrodes 18 and 16, it is possible to remove the external coupling capacitor. Therefore, the dielectric filter can be miniaturized and reduced in assembly parts.

According to the present invention, since the recess 15 in which the additional capacitance Cp is constructed is shaped such that the portion thereof opposing the ground electrode 12 is changed in length, it is possible to adjust the resonance frequencies of the dielectric resonators $R_1$, $R_2$ easily with high accuracy.

According to the present invention, since the pass band center frequency, the pass band width and the selectivity in the transmission characteristic of the filter can be separately adjusted by partly shaping the electrode in the recess 15 in which the additional capacitance Cp is constructed such that the large coupling capacitance is produced only in the ground electrode, the terminal electrode and the electrodes in the adjacent recesses, it is possible to adjust each of the pass band center frequency, the pass band width and the selectivity easily with high accuracy when the dielectric filter is manufactured.

According to the present invention, since the dielectric constant $\epsilon$ of the dielectric material used in the recess 15 in which the additional capacitance Cp is constructed on its side in which the electrode 16 is formed is selected to be lower than the dielectric constant $\epsilon$ of the dielectric body, it is possible to change the sizes of the electrode 16 in the recess 15 and the terminal electrode 18 in response to the purpose. Therefore, the dielectric filter of a desired dimension can be manufactured with ease.

According to the present invention, since the dielectric block 11 has on its surface of the side in which the additional capacitance Cp for the dielectric resonators $R_1$, $R_2$ is constructed the slit 19*a* extended to one side surface and the electrode 18*a* is formed on the inside of the slit 19*a* to thereby form the input and output coupling capacitances $C_1$, $C_3$, the dielectric filter can be surface-mounted on the mount substrate with ease by using the electrode 18*a*. Therefore, the dielectric filter can be simplified in arrangement.

According to the present invention, since the substrate 26 in which the conductor patterns 25*a*, 25*b* corresponding to the surface mount are formed is electrically connected to the surface in which the additional capacitance Cp is constructed, the dielectric filter can be easily surface-mounted on the mount substrate by using the conductor patterns 25*a*, 25*b*. Therefore, the dielectric filter can be simplified in arrangement.

Further, according to the present invention, since the input and output coupling capacitances $C_1C_3$ are constructed by disposing the dielectric 41 in which the electrode 42 is formed on at least one surface in a plurality of recesses 15 of the dielectric block 11, the external coupling capacitor can be removed and the dielectric filter can be miniaturized, reduced in assembly parts and made inexpensive. Moreover, according to the present invention, since the electrode 42 in which the coupling capacitances $C_1$, $C_3$ are formed is served also as the input and output terminal 42*a*, the dielectric filter can be surface-mounted on the mount substrate by the simple arrangement. Furthermore, according to the present invention, since the electrode 42 in which the coupling capacitances $C_1$, $C_3$ are constructed can be exposed, unlike the case that a commercially-available chip capacitor is used, it is possible to easily adjust the coupling capacitances $C_1$, $C_3$ by removing the electrode 42 even after the electrode 42 is connected to the dielectric block 11.

Furthermore, according to the present invention, since the coils 54 and 55 are connected between the dielectric input and output electrodes 42 (48) disposed in a plurality of recesses, it is possible to construct the band elimination filter without using the conventional repeating substrate. Therefore, the dielectric filter can be miniaturized, reduced in assembly parts and made inexpensive.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A dielectric filter comprising:

a plurality of dielectric resonators comprising a dielectric block having an outer conductor and a plurality of through-holes between first and second end surfaces, said plurality of through-holes having inner conductors electrically connected to said outer conductor at said first end surface;

spaced apart recesses formed on said second end surface of said dielectric block and aligned with said plurality of through-holes of said dielectric block; and electrodes formed within said recesses so as to communicate with said inner conductor to thereby form an additional capacitance, wherein said outer conductor comprises a ground electrode, and wherein said electrodes formed in said recesses in which said additional capacitance for said dielectric resonators are formed are shaped in the form of irregular polygons with one side of each of said polygons opposing said ground electrode.

2. A dielectric filter comprising:

a plurality of dielectric resonators comprising a dielectric block having an outer conductor and a plurality of through-holes between first and second end surfaces, said plurality of through-holes having inner conductors electrically connected to said outer conductor at said first end surface;

spaced apart recesses formed on said second end surface of said dielectric block and aligned with said plurality of through-holes of said dielectric block; and electrodes formed within said recesses so as to communicate with said inner conductor to thereby form an additional capacitance, wherein said dielectric block includes second recesses formed on said second end surface in which additional capacitance for said dielectric resonators is formed, and said second recesses include electrodes formed therein to construct at least one of input and output coupling capacitances, and said outer conductor of said filter comprises a ground electrode, and including terminal electrodes, and wherein shapes of electrodes formed in said recesses constructing said additional capacitance for said dielectric resonator are selected such that they have large coupling capacitances only for said ground electrode, terminal electrodes and electrodes of other recesses so that a pass band center frequency, a pass band width and a selectivity in a filter transmission characteristic can be adjusted independently.

3. A dielectric filter comprising:

a plurality of dielectric resonators comprising a dielectric block having an outer conductor and a plurality of through-holes between first and second end surfaces, said plurality of through-holes having inner conductors electrically connected to said outer conductor at said first end surface;

spaced apart recesses formed on said second end surface of said dielectric block and aligned with said plurality of through-holes of said dielectric block; and electrodes formed within said recesses so as to communicate with said inner conductor to thereby form an additional capacitance, wherein said dielectric block includes second recesses formed on said second end surface in which additional capacitance for said dielectric resonators is formed, and said second recesses include electrodes formed therein to construct at least one of input and output coupling capacitances, wherein said dielectric block comprises two portions of different dielectric constant, one of said portions on the side of said first end surface having a dielectric constant which is selected to be lower than a dielectric constant of said other portion.

* * * * *